US006886485B2

(12) United States Patent
Tomita et al.

(10) Patent No.: US 6,886,485 B2
(45) Date of Patent: May 3, 2005

(54) TWIN-RUDDER SYSTEM FOR LARGE SHIP

(75) Inventors: Yukio Tomita, Osaka (JP); Kenjiro Nabeshima, Osaka (JP); Toshihiko Arii, Osaka (JP); Takanori Wakabayashi, Osaka (JP)

(73) Assignee: Japan Hamworthy & Co., Ltd., Osaka (JP)

( * ) Notice: Subject to any disclaimer, the term of this patent is extended or adjusted under 35 U.S.C. 154(b) by 0 days.

(21) Appl. No.: 10/477,247

(22) PCT Filed: May 7, 2002

(86) PCT No.: PCT/JP02/04421

§ 371 (c)(1),
(2), (4) Date: Nov. 10, 2003

(87) PCT Pub. No.: WO02/090182

PCT Pub. Date: Nov. 14, 2002

(65) Prior Publication Data

US 2004/0163579 A1 Aug. 26, 2004

(30) Foreign Application Priority Data

May 9, 2001 (JP) ..... 2001-138030
Apr. 19, 2002 (JP) ..... 2002-116896

(51) Int. Cl.[7] ..... B63H 25/06
(52) U.S. Cl. ..... 114/163
(58) Field of Search ..... 114/163

(56) References Cited

U.S. PATENT DOCUMENTS 5,231,947 A * 8/1993 Kasahara et al. ..... 114/162

FOREIGN PATENT DOCUMENTS

JP 1-93197 6/1989
JP 05270492 A 10/1993
JP 6-6195 1/1994
JP 06127478 A 5/1994
JP 06247388 A 9/1994
JP 06305487 A 11/1994
JP 09039894 A 2/1997
JP 09066895 A 3/1997
JP 09086496 A 3/1997
JP 09136697 A 5/1997
JP 10071995 A 3/1998

* cited by examiner

*Primary Examiner*—Jesus D. Sotelo
(74) *Attorney, Agent, or Firm*—D. Peter Hochberg; Sean Mellino; Katherine R. Vieyra

(57) ABSTRACT

In such a high lift twin-rudder system that: a pair of high lift rudders 1, 2 is arranged behind a single propeller 3; the respective high lift rudder 1, 2 has a top end plate 6, 7 and a bottom end plate 8, 9 at the top end and the bottom of a rudder blade 4, 5; the respective rudder blade 4, 5 is provided with a reaction fin 10, 11, protruding from an inboard face of the rudder blade 4, 5 on a nearly same level with the axis of the propeller 3, that is originated nearly from the leading edge portion toward the rear and has a fixed chord length; the reaction fin 10 of the rudder blade 4 that faces on the board-side where the propeller blades rotate in the ascending direction assumes a posture that makes such attack angle that the ratio of a forward vectored thrust to a drag, both produced by a propeller slip stream having a stream component in the ascending direction, becomes maximum; and the reaction fin 11 of the rudder blade 5 that faces on the board-side where the propeller blades rotate in the descending direction assumes a posture that makes such attack angle that the ratio of a forward vectored thrust to a drag, both produced by a propeller slip stream having a stream component in the descending direction, becomes maximum, the respective rudder blade 4, 5 is so constituted that a chord length is of 60~45% of a propeller diameter.

4 Claims, 18 Drawing Sheets

FIG. 10

(SPECIFICATIONS OF MODEL SHIP)

| | | MODEL SHIP EQUIPPED WITH CONVENTIONAL SYSTEM (SINGLE RUDDER OF MARINER TYPE) | MODEL SHIP EQUIPPED WITH MODE FOR CARRYING OUT PRESENT INVENTION (HIGH LIFT TWIN-RUDDER SYSTEM) |
|---|---|---|---|
| HULL DIMENSION | | 4.0m LENGTH × 0.666m BREADTH × 0.39m DEPTH × 0.24m DRAFT | |
| PROPELLER | | 0.120m DIAMETER × 1 (BOSS CAP FINS ARE NOT APPENDED) | |
| RUDDER | CHORD LENGTH | 0.12/0.097m (MEAN 0.1085m) | 0.075/0.05m (MEAN 0.0625m) |
| | HEIGHT | 0.162m | 0.1075m |
| | NUMBER OF UNIT | 1 | 2 |
| | AREA: MOVABLE PORTION | 0.01422m² | 0.005375m² × 2=0.01075m² |
| | HORN POTION | 0.0033m² | - |
| | TOTAL | 0.01752m² | 0.01075m² |
| | OPERATING ANGLE | 35° + 35° | 60° + 30° |
| | FORM | SINGLE RUDDER OF MARINER TYPE 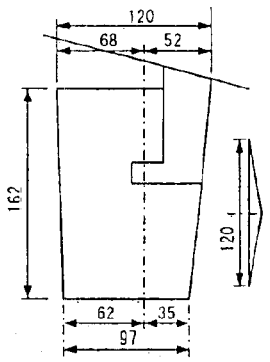  (1 SHEET) UNIT: mm | HIGH LIFT TWIN-RUDDER 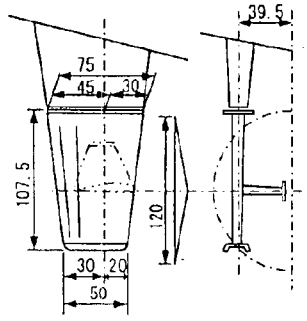  (2 SHEETS) UNIT: mm |

LATERAL FORCE AND ADVANCE FORCE ARE EXPRESSED WITH THE RATIO TO 1.0 THAT REPRESENTS MAGNITUDE OF PROPELLER THRUST ON THE OCCASION WHEN THE SHIP IS BOUND TO A BOLLARD AND THE PROPELLER IS OPERATED.

—●— TWIN-RUDDER SYSTEM IN ACCORDANCE WITH MODE FOR CARRYING OUT PRESENT INVENTION

---△--- CONVENTIONAL SINGLE RUDDER OF MARINER TYPE

FIG. 14

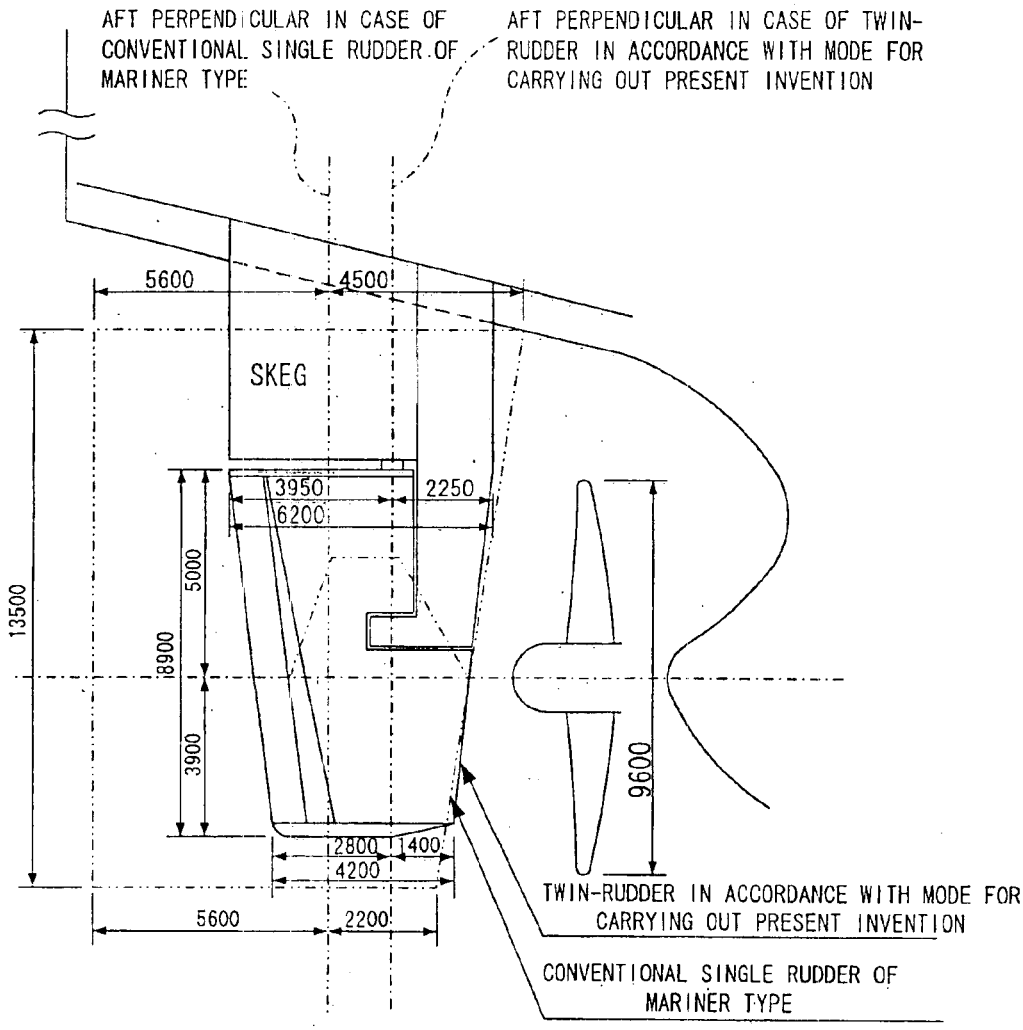

| | | |
|---|---|---|
| SHIP TYPE: | STANDARD SHIP TYPE OF VERY LARGE CRUDE OIL CARRIER OF 300,000DWT CLASS | |
| PRINCIPAL PARTICULARS: | L×B×D×d(m) | 320×60×30×20 |
| | PROPELLAR DIA. (m)×NO. | 9.6×1(FPP) |
| | SHIP SPEED(kt) | 16 |
| RUDDER DIMENSION: | AS ILLUSTRATED ABOVE (NOTE: WHOLE AREA OF TWIN-RUDDER IN ACCORDANCE WITH MODE FOR CARRYING OUT PRESENT INVENTION IS ABOUT 77% OF THAT OF CONVENTIONAL SINGLE RUDDER OF MARINER TYPE.) | |
| LENGTH OF MODEL SHIP: | 7m (PROPELLER BOSS CAP FINS ARE NOT APPENDED) | |

——— CURVE BASED ON MEASURED VALUE IN CASE OF CONVENTIONAL SINGLE RUDDER OF MARINER TYPE

— — — CURVE BASED ON MEASURED VALUE IN CASE OF TWIN-RUDDER IN ACCORDANCE WITH MODE FOR CARRYING OUT PRESENT INVENTION

— · — ANTICIPATED CURVE INTRODUCED MODIFICATIONS TO THE ABOVE

FIG. 16

(TRIAL DESIGN APPLIED TO FULL SCALE SHIP)

| | | CONVENTIONAL SYSTEM (SINGLE RUDDER OF MARINER TYPE) | MODE FOR CARRYING OUT PRESENT INVENTION (HIGH LIFT TWIN-RUDDER SYSTEM) |
|---|---|---|---|
| HULL DIMENSION | | 320m LENGTH × 60m MOULDED BREADTH × 29.55m MOULDED DEPTH × 18.96m DRAFT 300,000DWT CLASS | |
| MAIN ENGINE | | 35,000ps × 80rpm | |
| PROPELLER | | 9.6m DIAMETER × 1 | |
| DESIGN SPEED | | 17.3kt | |
| RUDDER | CHORD LENGTH | 11.82/8.86m (MEAN 10.340m) | 6.00/4.00m (MEAN 5.00m) |
| | HEIGHT | 13.8m | 8.9m |
| | NUMBER OF UNIT | 1 | 2 |
| | AREA (MOVABLE PORTION) | 115.40m² | 44.5m² × 2=89.0m² |
| | RUDDER TORQUE | 650t-m | 160t-m × 2=320t-m |
| | OPERATING ANGLE | 35° + 35° (TOTAL 70°) | 60° + 30° (TOTAL 90°) |
| | WEIGHT (INCLUDING HORN) | 360t | 135t × 2=270t |
| | FORM | SINGLE RUDDER OF MARINER TYPE 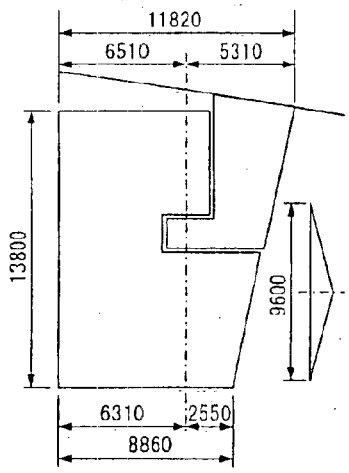  | HIGH LIFT TWIN-RUDDER 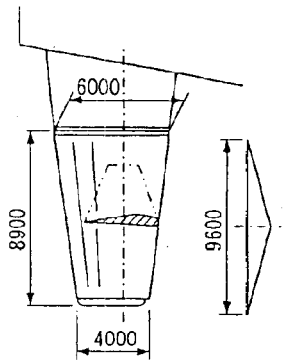  (2 SHEETS) |
| STEERING GEAR | TYPE | RAM TYPE (2 RAM-4 CYLINDER) | ROTARY VANE TYPE |
| | NO. OF UNIT | 1 UNIT | 2 UNITS |
| | CAPACITY | 650t-m | 167.4t-m × 2=334.8t-m |
| | OPERATING ANGLE | 35° - 0° - 35° | 60° - 0° - 30° |
| | MOTOR | (140kw × 2) | 37kw × 2 × 2 SETS |
| | REMARKS | | IN CASE OPERATING ANGLE OF 110° — 0° — 30° IS APPLIED: (1) RUDDER TORQUE: 174.3t-m × 2=348.6t-m (2) TURNING SPEED: 28sec/140° (3) MOTOR: 37kw × 2 × 2 SETS |

TWIN-RUDDER SYSTEM FOR LARGE SHIP

CROSS REFERENCE TO RELATED APPLICATION

This application is the National Stage of International Application No. PCT/JP02/00841 filed May 7, 2002.

TECHNICAL FIELD TO WHICH THE INVENTION PERTAINS

The present invention relates to a twin-rudder system for very large vessels, and is concerned with technology to utilize propeller slip stream effectively.

BACKGROUND OF THE INVENTION

A conventional rudder system for very large vessels is such that, as shown in FIG. 21–FIG. 22, a rudder 51, an overwhelming majority of which is of so-called Mariner type, is disposed behind a propeller 3. The rudder 51 is supported free rotatably by a pintle 54 provided at a lower end of a streamlined horn 53, which is protruded downward from a bottom center of a stem 52. The maximum rotatable angle of the rudder 51 is 35° at its one end and 35° at its other end, 70° in total.

Conventionally, a rudder area has been determined based on actual results so that a value that a projected flood area, namely a multiplier of ship length and draft, is divided by a rudder area (rudder area ratio) is within a certain range, though different depending on ship length and ship kind.

Recently, however, maneuverability of very large vessels such as a very large crude oil carrier etc., which embrace problems in course stability and follow-up controllability, when navigating in narrow waters and ports, has come to the front, and it is the existing state that, in order to meet the IMO (International Maritime Organization) maneuverability criteria, such a measure is taken as to not only alter ship form but also reduce rudder area ratio, namely increase rudder area. Accordingly, it is the present state that globally very large vessels are provided with such a large rudder 51 that its average chord length c' extends to such degree as 110% of a propeller diameter d.

Besides, such a concept is in existence as to provide two propellers, and a rudder is provided behind the respective propeller. This simply arranges two sets of the above-mentioned system of a single propeller and a single rudder, aiming at safety when either of the propulsion engines fails. In this case, it is so arranged that two rudders are turned synchronously up to the maximum rudder angle of 35° port and 35° starboard.

The necessity for increasing rudder area in the conventional rudder system as mentioned above has caused problems such that not only the rudder becomes heavy in construction and requires large steering gear capacity, but also it may bring a lowering of propulsive performance, and that, as the case may be, there is possibility of requiring enlargement of hull dimension to secure space for the enlarged rudder, all these causing economic loss.

In addition, there has been a problem that, even if rudder area is increased, an increase of the rudder force is not so high and it is not so effective for improvement of maneuverability due to low speed when navigating in narrow waters and ports, despite the need for high maneuverability in the very narrow waters and ports.

Furthermore, in a conventional rudder, an increase of rudder operating angle has been less effective for improvement of maneuverability because lift of the rudder suddenly decreases when exceeding 35°.

Furthermore, there has been a problem that the conventional rudder system as mentioned above may make the ship incapable of maneuvering and may cause lost safety in case either rudder or steering gear fails. If two sets of the conventional rudder system are provided, such a problem is solved, but it would be impractical because it causes another problem that propulsive efficiency is lowered and cost becomes high due to enlarged space requirement and facilities. In addition, there is a problem that there is a case where rudder force can not be effectively generated at large rudder angles by interfering action of a stream that flows between two rudders as they are turned synchronously.

As for rudder angle control system for a ship provided with twin rudders, a conventional system has been such that, as shown in FIG. 23 for example, an auto-pilot 62 controls a port rudder 61*p* and a starboard rudder 61*s* so that they are turned synchronously, and that the respective rudder can be turned up to the same maximum rudder angle toward port side and starboard side.

Namely, when a rudder angle order signal δi is issued from either an automatic steering apparatus 62*a* or a steering wheel 62*b* of the auto-pilot 62, the signal $\delta_i$ is input into a port control amplifier 63*p*, as it is, for controlling a port rudder 61*p* and a starboard control amplifier 63*s* for controlling a starboard rudder 61*s*, respectively, in a synchronous manner. Hereby the port and starboard control amplifiers 63*p*, 63*s* issue order signals to a port hydraulic pump unit 65*p* of a port steering gear 64*p* so as to make a port rudder 61*p* operate, and a starboard hydraulic pump unit 65*s* of a starboard steering gear 64*s* so as to make a starboard rudder 61*s* operate, respectively, and the port and starboard steering gears 64*p*, 64*s* and the port and starboard rudders 61*p*, 61*s* begin to turn synchronously in the same direction.

A moving amount of the port rudder 61*p* is fed back to the port control amplifier 63*p* as a port rudder angle feedback signal $\delta_{fp}$, and a moving amount of the starboard rudder 61*s* is fed back to the starboard control amplifier 63*s* as a starboard rudder angle feedback signal $\delta_{fs}$, respectively. When the signals come to such relation as $\delta_{fp}=\delta_i$ and $\delta_{fs}=\delta_i$, the control amplifiers 63*p*, 63*s* make operation of the port and starboard hydraulic pump units 65*p*, 65*s* stop, respectively, and the port and starboard rudders 61*p*, 61*s* are kept at the rudder angle $\delta_i$ ordered by the automatic steering apparatus 62*a* or the steering wheel 62*b* of the auto-pilot 62.

According to the conventional auto-pilot as abovementioned, there is such a problem that two rudders are unable to effectively generate rudder force at large rudder angles due to synchronous operation of two rudders, which causes mutual interfering action of a deflected propeller slip stream that streams between the port and starboard rudders.

In addition, a rudder's working angle range becomes necessarily large because the maximum inboard operable angle is equal to the maximum outboard operable angle, and thus there is such a problem that the maximum operable angle should be compelled to be restricted due to a restriction on steering gear mechanism, resulting in incapability of developing large rudder force.

Furthermore, the conventional auto-pilot does not manage such control as to, in a twin rudder arrangement, turn the respective rudders toward outboard and give a ship brake force against onward movement, while such a special character of control can be utilized for crash stopping (or crash astern) maneuver of a ship.

In case of crash stopping (or crash astern) maneuver of a ship, it is performed by means of reversing propeller revolution by reversing operation of a main engine or a clutch provided in a reduction gear to stop an onward moving ship and further make the ship go astern.

On this occasion, the ship continues moving onward by large inertia force even after fuel supply to a main engine is stopped, and a propeller idles. If the propeller is so controlled as to be reversed on this condition, the propulsive system will come to be over-loaded; accordingly, it is usual practice that reversing the main engine or the clutch of reduction gear is carried out after onward moving speed of the ship by inertia force or free rotating speed of the propeller has come down to a certain value in the course of nature.

There is a problem in that a long time is required until it becomes possible to give the ship positive astern power, and in the meanwhile, the ship continues running onward by inertia force, covering an extremely long distance, which means that risk of collision increases, and that ship maneuvering crew is compelled to accept the great labors for avoiding risk.

Furthermore, in case that a ship is propelled by a main diesel engine and a propeller is of fixed pitch, there is a problem that, as the main diesel engine revolution is unable to be decreased lower than "dead slow" which is the lowest allowable revolution, a considerably high undesirable ship speed remains. In case a twin rudder arrangement is equipped, however, it is possible that, by such means that the respective rudders are turned toward outboard and their turned angles are controlled, a ship speed can be decreased beyond the speed corresponding to the main diesel engine dead slow revolution voluntarily, within the limit of the rudders' maximum operable angles toward outboard, and that ship's heading can be controlled. Nevertheless, the conventional auto-pilot does not manage such control.

The present invention aims at offering such a twin-rudder system for very large vessels that two high lift rudders, respective blade chord length of which is made about a half of a propeller diameter, are arranged behind a single propeller, and that respective rudder angles are controlled so that they can co-work most effectively, which enables:

To provide a very large vessel with excellent maneuverability, including braking ability, not only at high speed navigation, but also especially at low speed navigation in narrow waters and ports;

Nevertheless, to secure propulsive performance equal with or higher than that of the case that a conventional rudder system is equipped;

To make rudder construction light;

To shorten ship length or increase stowage capacity due to shortened rudder sizes;

To reduce required capacity and required working angle for steering gears;

To adopt a simple rudder supporting system of hanging type;

To secure ship maneuvering ability with safety, even in case that something has been wrong with either of the rudders or the steering gear;

To make two rudders effectively generate rudder force, even in case the rudders are largely steered when a ship is at turning maneuver or head changing maneuver, by such a means that two rudders are less influenced by mutual interfering action of a deflected propeller slip stream streaming between two rudders;

To decrease a required working angle range of steering gears in spite of the increased maximum rudder operable angle;

To greatly shorten a ship's crash stopping distance, when the ship is at crash stopping (or crash astern) maneuver, by utilizing two rudders as brake against onward movement of the ship; and To reduce a ship speed beyond the speed corresponding to the lowest allowable revolution of a main diesel engine, with an ability of controlling ship's heading, by utilizing two rudders.

DISCLOSURE OF INVENTION

In order to resolve the aforementioned problems, the present invention of a twin-rudder system for very large vessels is constituted so that chord length of respective rudder blades is of 60~45% of a propeller diameter in such a high lift twin-rudder system that:

A pair of high lift rudders is arranged behind a single propeller nearly parallel in a symmetrical position against the propeller axis;

The respective rudder has a top end plate and a bottom end plate provided at the top end and the bottom of a rudder blade, respectively;

The respective rudder blade has such horizontal sectional profile that a semicircular leading edge portion protrudes forward, a mid body portion, continuous with the leading edge portion, increases its width up to the maximum width portion in streamline shape, and then gradually decreases its width toward the minimum width portion; and a fish tail trailing edge portion, continuous with the mid body portion, gradually increases its width toward a rear end face having a fixed width; and The respective rudder blade is provided with a reaction fin, protruding from its inboard face on a nearly same level with the propeller axis, that is originated nearly from the leading edge portion of the rudder blade toward the rear and has fixed chord length, with one of the reaction fins, that faces on the board-side where the propeller blades rotate in the ascending direction, assuming a posture that makes such attack angle that the ratio of a forward vectored thrust to a drag, both produced by a propeller slip stream having a stream component in the ascending direction, becomes maximum, and other of the reaction fins, that faces on the board-side where the propeller blades rotate in the descending direction, assuming a posture that makes such attack angle that the ratio of a forward vectored thrust to a drag, both produced by a propeller slip stream having a stream component in the descending direction, becomes maximum.

Thanks to the aforementioned constitution in accordance with the present invention, the respective rudder is, when it is given an angle for maneuvering a ship, able to produce large lift since lift produced by blade function or by hydraulic pressure becomes large by virtue of a propeller slip stream confined inside the top and bottom end plates of the rudder blade, and that a reactive force caused by the deflected stream at the fish tail trailing edge portion is added as lift.

In addition, generation of the lift lasts without stalling even on the occasion when rudder angle is increased beyond the conventional maximum angle of 35°, and that the more rudder angle increases, the more drag becomes large and a ship speed is reduced, and thus ship's maneuverability can be improved. Furthermore, by virtue of two rudders, total vertical length of rudder blade portions near the leading edge where lift is most intensively generated comes to about twice longer than that in case of a single rudder, and that total vertical length of fish tail trailing edge portions that are another source of lift generation also comes to about twice longer, and thus as a whole, great lift can be generated. Furthermore, by virtue of co-work of two rudders, the lift becomes further large as a whole by effect of mutual interaction.

Accordingly, the rudder system of the present invention can exhibit, despite the shortened chord length of the rudder blades to such a value as 60~45% of the propeller diameter, excellent maneuverability, namely, excellent course keeping quality, turning ability, changing head ability and stopping ability, not only in high speed navigation, but also even on the occasion of low speed navigation in narrow waters and ports, much more than those of a conventional single rudder system, in which chord length of a rudder blade is made as about 110% of a propeller diameter.

Furthermore, in the neutral position of the rudders when a ship goes straight ahead, the reaction fin of the respective rudders converts rotating energy of a propeller slip stream, which rotatively streams rearward between two rudders, into lift having a forward vectored component.

Accordingly, an increase in viscous pressure resistance at the fish tail trailing edge portions in the neutral position of the rudders when a ship goes straight ahead, and deteriorative tendency of a thrust deduction coefficient in a self-propulsion factor caused by two sheets of rudders behind a single propeller can be compensated with the forward vectored thrust generated by the reaction fins, and in addition, decrease in resistance by reduced total rudder area, and thus it is possible to make the propulsive efficiency equal with or higher than that of a conventional single rudder system.

Furthermore, the reduction in chord length of rudder blade comes to make rudder height shorten to some extent, and consequently the rudder area per a high lift rudder decreases to about 30~40% of the rudder area, including a horn, of a conventional single rudder of Mariner type. Accordingly, construction and weight per a rudder are remarkably lightened, compared with those in a conventional system. This makes it possible to change a conventional rudder supporting system of Mariner type into a hanging rudder system of simple construction. In addition, the reduction of rudder sizes makes it possible to reduce hull length or increase stowage capacity.

Furthermore, total required capacity for two steering gears can be reduced to the extent of about 50% of that in a conventional single rudder system of Mariner type; namely, required capacity per a steering gear is reduced to the extent of about 25% of that in the conventional system, and thus there is no necessity for employing such a steering gear of extra large capacity that requires special manufacturing as used in the conventional system.

Furthermore, even if a rudder of one side or its steering gear got out of order, ship maneuvering ability can be maintained by a remainder, and thus safety is remarkably improved, compared with a case of a conventional single rudder system.

The present invention of a twin-rudder system for very large vessels in one embodiment is constituted so that an interval between the revolving center of the respective high lift rudder and the propeller axis is of 25~35% of a propeller diameter, and a gap between the tips of the leading edge portions of the respective rudder blades in a condition that the respective high lift rudders are turned to the maximum angle toward outboard is 40~50 mm at the maximum.

Thanks to the aforementioned constitution in accordance with the present invention, even when either rudder is turned to the maximum angle toward outboard, an area of the portion where flux of a propeller slip stream applies to the rudder blade can be increased; namely, it is possible to make the rudders generate larger lift, and thus maneuverability is further improved.

In addition, in a condition that both rudders are turned to the maximum outboard operable angle, respectively, the respective rudder blades perform braking action against onward movement of a ship, and that a runaway stream of a propeller slip stream passing through the gap between the tips of the leading edge portions of both rudder blades is restrained as the gap is quite small. Accordingly, advance thrust produced by a propeller decreases, and drag generated on the rudder blades becomes maximum, and thus it is possible to stop a ship quickly, and safety is remarkably improved.

The present invention of a twin-rudder system for very large vessels in a second embodiment is constituted so that a fish tail trailing edge portion of the rudder blades, continuous with the mid body portion, gradually increases its width, only unilaterally to outboard side, toward a rear end face having a fixed width.

Thanks to the aforementioned constitution in accordance with the present invention, it is possible, in the neutral position of the rudders when a ship goes straight ahead, to reduce viscous pressure resistance at the fish tail trailing edge portion by half, and improve propulsive efficiency. On the other hand, generation of lift at the fish tail trailing edge decreases, but by virtue of the matter that stream deflecting action by the fish tail trailing edge is performed on the outboard side with emphasis where such action is more effectively performed, decrease in lift generation as a whole can be restrained to the minimum. With this constitution, therefore, excellent maneuverability, namely, excellent course keeping quality, turning ability, changing head ability and stopping ability, can be still exhibited, compared with the case of a conventional single rudder system.

The present invention of a twin-rudder system for very large vessels in a third embodiment is constituted so that an end plate that bends in either direction, upward, downward or both upward and downward in a fixed length, is provided on the end face of the respective reaction fins of the rudder blades.

Thanks to the aforementioned constitution in accordance with the present invention, it is possible to reduce edge effect and generation of free vortex at a tip of the reaction fins by the end plate of the reaction fins. It is possible to extend lift distribution on the blade face of the reaction fins up to the end, and in addition, convert a part of free vortex into forward vectored thrust. Accordingly, lift conversion efficiency of the reaction fins becomes high, and thus it is possible to further improve propulsive efficiency.

The present invention of a twin-rudder system for very large vessels in a fourth embodiment is constituted so that fins are appended on a propeller boss cap, so that the propeller boss caps generate a stream in the same direction as a propeller slip stream generated by propeller blades.

Thanks to the aforementioned constitution in accordance with the present invention, it is possible to reduce generation of hub vortex at the central part of a flux of the propeller slip stream, and accordingly propulsive efficiency is improved. In the case that a rudder exits behind a propeller just in the center of the propeller axis, the rudder has the effect of restraining generation of the hub vortex to some extent. In the present invention, however, there is no rudder in the center of the propeller axis; therefore, a degree of effectiveness to restrain generation of hub vortex by appending the fins on the propeller boss cap is extremely great.

The present invention of a twin-rudder system for very large vessels in a fifth embodiment is constituted so that an auto-pilot is provided for controlling rudder angles of the respective rudders by operating steering gears provided for the respective rudders, and has such control function that the respective rudders are operated so that the maximum outboard operable angle is larger than the maximum inboard operable angle.

Thanks to the aforementioned constitution in accordance with the present invention, it is possible to make two rudders effectively generate rudder force because, when two rudders are turned to the maximum operable angle in the same direction on the occasion of ship's turning or changing head maneuver, namely, in case of hard port, for instance, when the port rudder is turned to the maximum outboard operable angle in the port direction, and the starboard rudder is turned to the maximum inboard operable angle, that is smaller than the angle of the port rudder, in the port direction, less influence is exerted upon the port and starboard rudders by mutual interfering action of a deflected propeller slip stream, and in addition, it is possible to make a required working angle range of steering gears small.

The present invention of a twin-rudder system for very large vessels in a sixth embodiment is constituted so that an auto-pilot is provided with a functional circuit for crash stopping maneuver that controls the respective rudders at crash stopping, and a crash stopping push button to start the functional circuit for crash stopping maneuver, the functional circuit for crash stopping maneuver having control function to make the respective rudders turn to the maximum outboard operable angle, respectively.

Thanks to the aforementioned constitution in accordance with the present invention, it is possible to make two rudders generate brake force against onward movement of a ship at crash astern maneuver (or crash stopping maneuver) of the ship, when crash stopping is required, by pushing the crash stopping push button of the auto-pilot for starting the functional circuit for crash stopping maneuver, which makes the port and starboard rudders turn up to the maximum outboard operable angle, respectively. Accordingly, it is possible to shift ship maneuver to "go astern" from "go ahead" in a short time as the ship speed is quickly reduced, and thus it is possible to remarkably shorten stopping distance of the ship.

Furthermore, taking advantage of such function as making the respective rudders turn toward outboard, respectively, it is possible for a ship having a main prime mover of diesel engine and a fixed pitch propeller to reduce ship speed as desired to a level below the speed corresponding to the allowable lowest revolution (dead slow) of the main diesel engine, and that in the meantime, ship's heading angle can be controlled during navigation with such reduced ship speed, with the respective rudder being operated toward outboard and their angles being controlled, though the reducible minimum speed depends on what the possible maximum angle of the rudders toward outboard is.

The present invention of a twin-rudder system for very large vessels in a seventh embodiment is constituted so that an auto-pilot is provided with a functional circuit for crash stopping maneuver that controls the respective rudders at crash stopping, the functional circuit for crash stopping maneuver having control function to make the respective rudders turn to the maximum outboard operable angle, respectively, in response to a fuel shut-off signal issued by a main engine control system at crash astern maneuver.

Thanks to the aforementioned constitution in accordance with the present invention, it is possible to make two rudders generate brake force against onward movement of a ship at crash astern maneuver of the ship by making the port and starboard rudders automatically turn up to the maximum outboard operable angle, respectively, in response to a signal issued by the main engine control system, that starts the functional circuit for crash stopping maneuver, having no need of doing such special operation as pushing a crash stopping push button of an auto-pilot. Accordingly, it is possible to shift ship maneuver to "go astern" from "go ahead" in a short time as the ship speed is quickly reduced, and thus it is possible to remarkably shorten stopping distance of the ship.

BRIEF DESCRIPTION OF DRAWINGS

FIG. 10 shows a diagram illustrating model ship specifications for a test by a model ship about a twin-rudder system for very large vessels in accordance with the present invention;

FIG. 14 shows specifications of a ship and her rudders as well as a drawing of her stern equipped with the rudders that were made the target of a test by a model of a very large crude oil carrier with respect to a twin-rudder system for very large vessels in accordance with the present invention;

FIG. 16 shows a diagram illustrating a result of a trial design for a full-scale ship, to which a twin-rudder system for very large vessels in accordance with the present invention is applied;

THE BEST MODE FOR CARRYING OUT THE INVENTION

Figure 1:
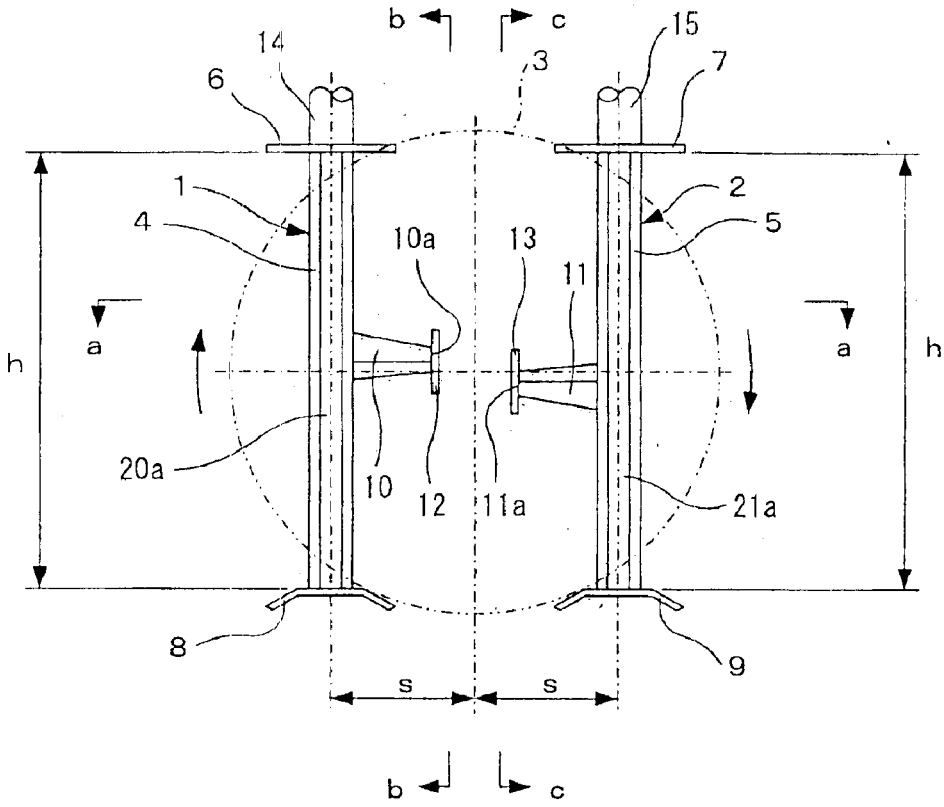
FIG. 1 shows a rearview of a twin-rudder system for very large vessels in accordance with the mode for carrying out the present invention.
Figure 2:
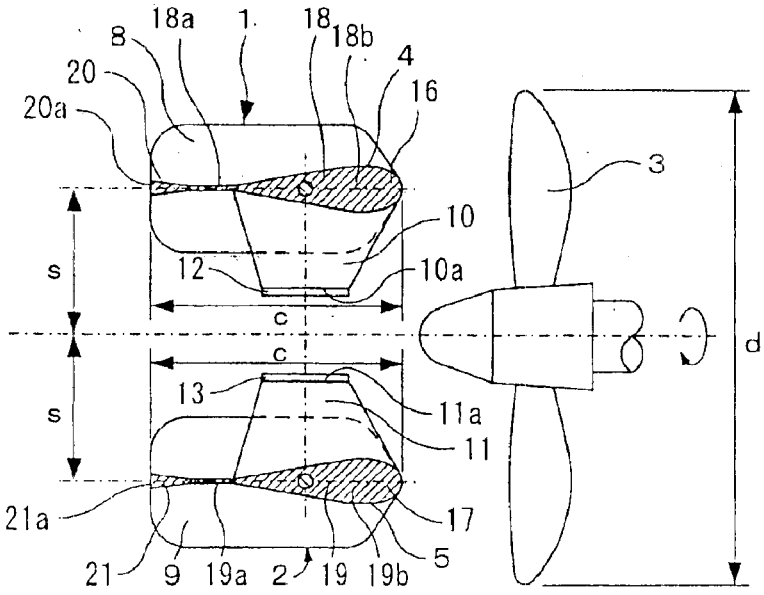
FIG. 2 shows a plane view of a section seen along the arrows a—a in FIG. 1 in accordance with the same twin-rudder system for very large vessels.
Figure 3:
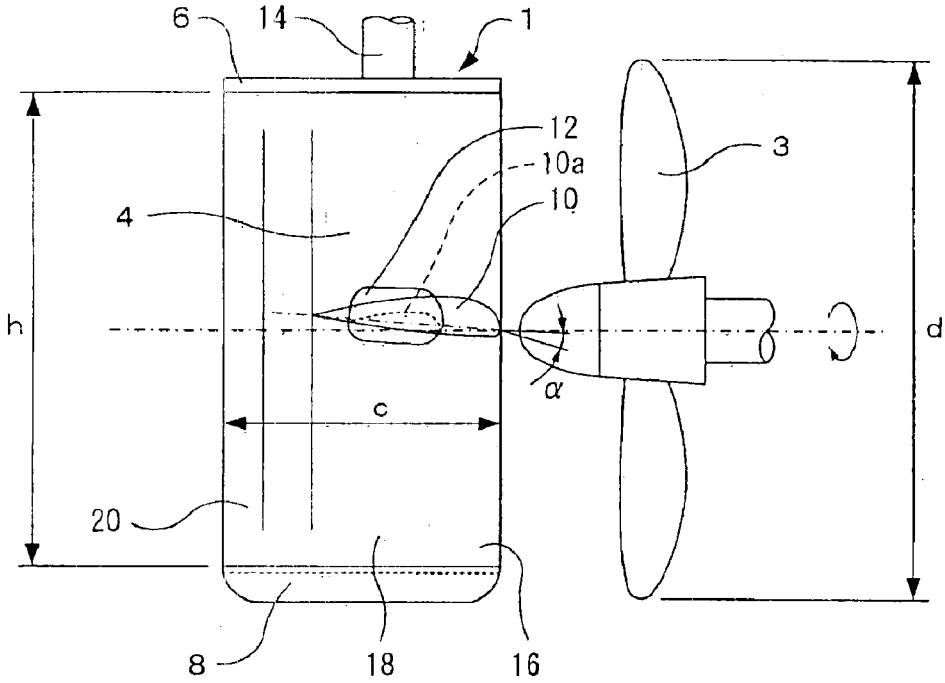
FIG. 3 shows a side view seen along the arrows b—b in FIG. 1 in accordance with the same twin-rudder system for very large vessels.
Figure 4:
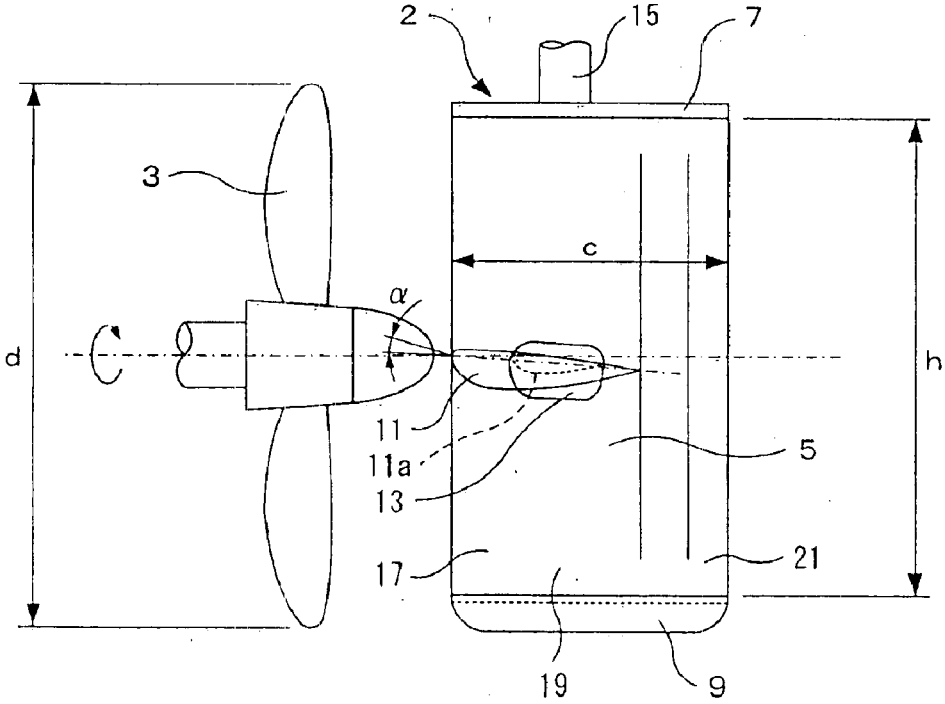
FIG. 4 shows a side view seen along the arrows c—c in FIG. 1 in accordance with the same twin-rudder system for very large vessels.

The mode for carrying out the present invention is described and illustrated below with reference to the accompanying drawings. In FIG. 1~FIG. 4, a pair of high lift rudder 1, 2 is arranged behind a single propeller 3 in a symmetrical position against the propeller axis or the hull center line, and the figures show a condition that the propeller 3 rotates clockwise, being seen from behind.

The high lift rudders 1, 2 arranged in the port and starboard sides are respectively composed of a port rudder blade 4 and a starboard rudder blade 5; top end plates 6, 7 of flat shape respectively provided at the top end of the port and starboard rudder blades 4, 5, being overhung toward both sides; bottom end plates 8, 9 respectively provided at the bottom of the rudder blades 4, 5, being overhung toward both sides, with both edge end portions being bent a little downward; port and starboard reaction fins 10, 11 protruding from an inboard face of the port and starboard rudder blades 4, 5, respectively, on a nearly same level with the axis of the propeller 3; flat shaped end plates 12, 13 each in a fashion to extend for a fixed distance in either direction, upward, downward or both upward and downward, provided on the inboard end face of the port and starboard reaction fins 10, 11, respectively; and rudder stocks 14, 15 connected to a top face of the rudder blades 4, 5, respectively, at the rotating center.

The respective rudder blades 4, 5 have horizontal sectional profile consisting of; semicircular leading edge portions 16, 17 protruded forward; mid body portions 18, 19 that are continuative with the leading edge portions 16, 17, increase their width up to the maximum width portions 18*b*, 19*b* in streamline shape, and then gradually decrease their width toward the minimum width portions 18*a*, 19*a*; and fish tail trailing edge portions 20, 21 that are continuative with the mid body portions 18, 19, and gradually increase their width toward rear end faces 20*a*, 21*a* having a fixed width.

The port reaction fin 10 of the port rudder blade 4, that faces on the board-side where the blades of the propeller 3 rotate in the ascending direction, has a blade section having a fixed chord length originated from the leading edge portion 16 of the rudder blade 4 toward the rear, and assumes a posture that makes such attack angle a that the ratio of a forward vectored thrust to a drag, both produced by a propeller slip stream of the propeller 3 having a stream component in the ascending direction, becomes maximum. The end plate 12 provided on the end face 10*a* of the port reaction fin 10 is arranged in parallel with the axis of the propeller 3, or along streamline vector of a propeller slip stream of the propeller 3.

The starboard reaction fin 11 of the starboard rudder blade 5, that faces on the board-side where the blades of the propeller 3 rotate in the descending direction, has a blade section having a fixed chord length originated from the leading edge portion 17 of the rudder blade 5 toward the rear, and assumes a posture that makes such attack angle a that the ratio of a forward vectored thrust to a drag, both produced by a propeller slip stream of the propeller 3 having a stream component in the descending direction, becomes maximum. The end plate 13 provided on the end face 11*a* of the starboard reaction fin 11 is arranged in parallel with the axis of the propeller 3, or along streamline vector of a propeller slip stream of the propeller 3.

An average chord length c of the respective rudder blades 4, 5 is set on the basis of a propeller diameter d of the propeller 3 and is of 60~45% of the propeller diameter, and rudder blade height h is of about 90% of the propeller diameter d of the propeller 3. An interval s between the revolving center of the respective rudder blades 4, 5 and the axis of the propeller 3 is of about 25~35% of the propeller diameter d of the propeller 3.

The respective rudder blades 4, 5 are capable of being turned to the extent of 60°, for instance, toward outboard and 30°, for instance, toward inboard, respectively. In a condition that both rudder blades 4, 5 are turned to the extent of 60°, for instance, toward outboard, respectively, a gap between the tips of the leading edge portions 16, 17 of the respective rudder blades 4, 5 is 40~50 mm at the maximum.

Function in the aforementioned constitution is described in the following: When the rudder 1 or 2 is given angle for maneuvering a ship, a flux of a propeller slip stream of the propeller 3 is applied to the rudder blades 4, 5 with enough projected area as the respective revolving center of the rudder 1, 2 is situated at a distance of 25~35% of the diameter d of the propeller 3 from the axis of the propeller 3, and streams onto faces of the rudder blade 4 or 5 in such a manner as to be confined inside the top end plate 6 or 7 and the bottom end plate 8 or 9 of the rudder blades 4, 5. Accordingly, lift is largely produced by blade function or by hydraulic pressure of the stream, and that lift becomes further large as reactive force caused by the deflected stream at the fish tail trailing edge portion 20 or 21 is added as lift. In addition, generation of lift lasts without stalling even on the occasion when rudder angle is increased beyond the conventional maximum angle of 35°, and the more the rudder angle increases, the more drag becomes large and a ship speed is reduced, and thus ship's maneuverability is improved. Furthermore, by virtue of two sheets of the rudders 1, 2, total vertical length of the portions near the leading edge portions 16, 17 of the rudder blades where lift is most intensively generated comes to about twice as long as that in case of a single rudder, and that total vertical length of the fish tail trailing edge portions 20, 21 that are another source of lift generation also comes to about twice as long, and thus as a whole, great lift can be generated. Furthermore, by virtue of co-work of rudder angles of two rudders 1, 2, the lift becomes larger as a whole by effect of mutual interaction.

Figure 21:
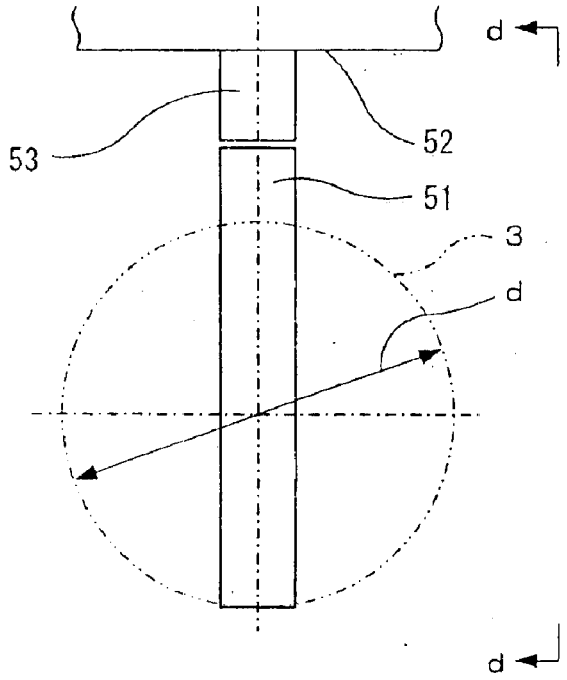
FIG. 21 shows a rear view of a conventional rudder system for very large vessels.
Figure 22:
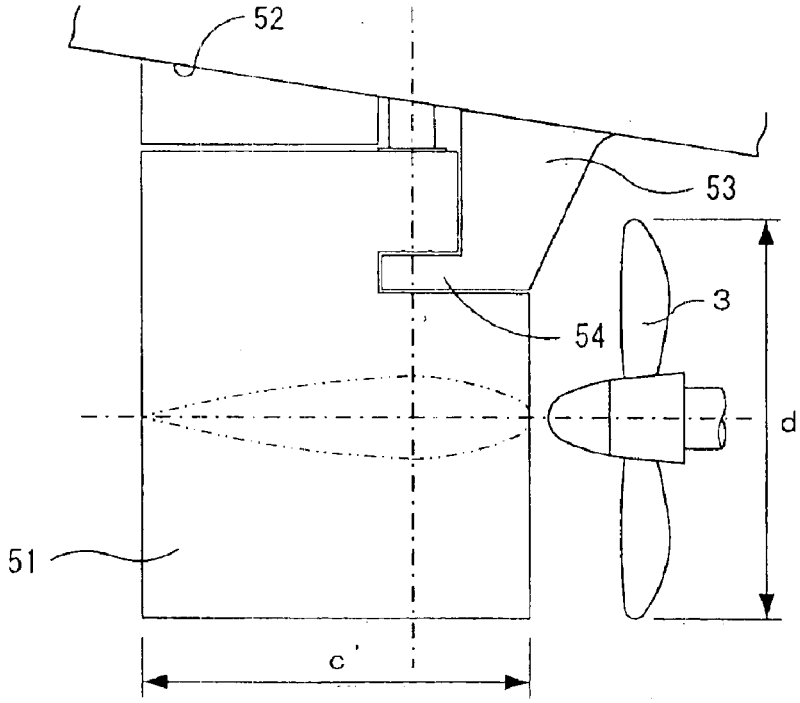
FIG. 22 shows a side view seen along the arrows d—d in FIG. 21 in accordance with the same conventional rudder system for very large vessels.
Figure 23:
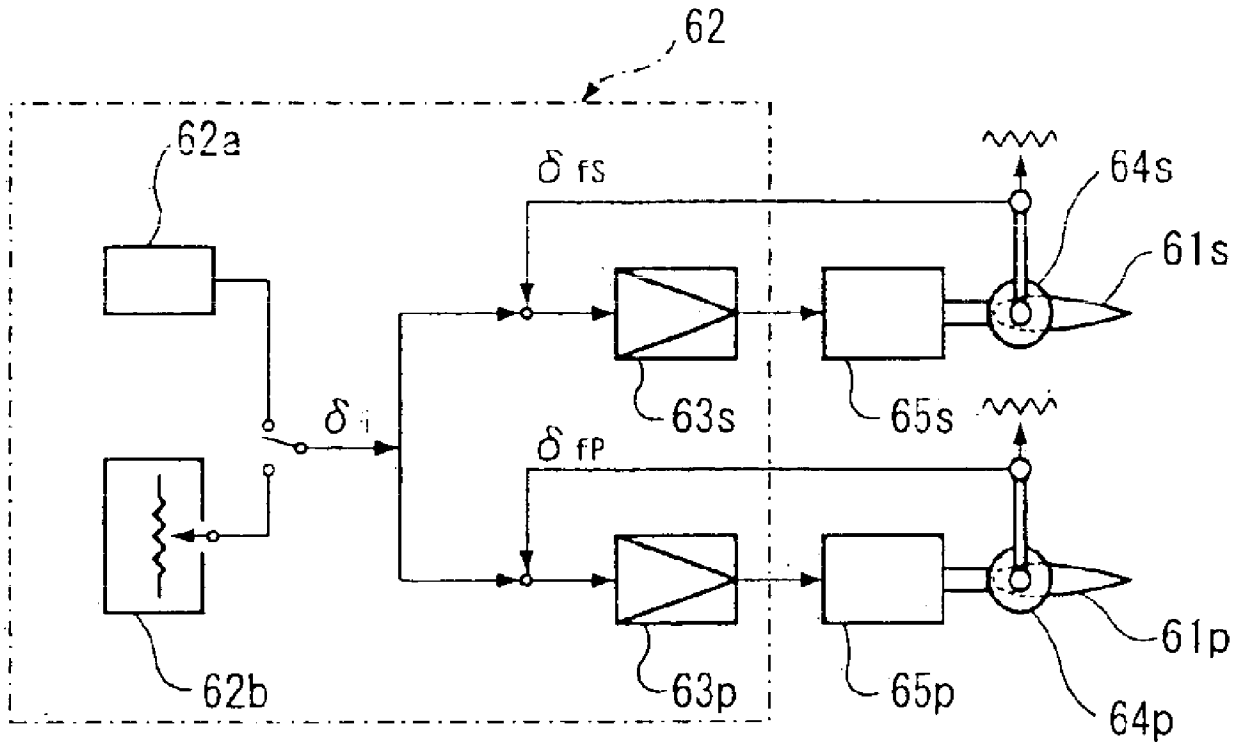
FIG. 23 shows an explanatory drawing of a circuit of a conventional rudder angle control system.

In the single rudder system with the conventional rudder 51 of Mariner type (as shown in FIG. 21–22), even if rudder blade area is increased, an increase in rudder force generated is not in proportion to the increase in rudder area as, when steering, it is within the partial range that a propeller slip stream of the propeller 3 strongly acts on a rudder blade. As the range where generation of rudder force depends on velocity of a water current, not a propeller slip stream, becomes large, it is unable to generate enough force due to a reduced stream velocity when navigating with low speed in narrow waters or ports. In the mode for carrying out the present invention, larger rudder force can be generated as a propeller slip stream of the propeller 3 acts on the almost whole surface of the rudder blades 4, 5, and because it acts on the rudder blades 4, 5, with its energy being confined inside the top end plates 6, 7 and the bottom end plates 8, 9, and high maneuverability can be exhibited even when navigating with a low speed in narrow waters and ports.

Accordingly, in spite of the shortened chord length c of the rudder blades 4, 5, which is 60~45% of the propeller diameter d of the propeller 3 and the shortened height h of the rudder blades, which is about 90% of the propeller diameter d of the propeller 3; namely, total area of two rudder blades 4, 5 is of about 55~70% of rudder area, including the horn 53, of the conventional single rudder system of Mariner type, the blade chord length c' of which is enlarged as about 110% of the propeller diameter d, the rudder system in accordance with the present invention exhibits more excellent maneuverability; namely, excellent course keeping quality, turning ability, changing head ability and stopping ability not only in high speed navigation, but also even on the occasion of low speed navigation in narrow waters and ports than those of the conventional system.

Furthermore, in the neutral position of the rudders when a ship goes straight ahead, the reaction fins 10, 11 of the respective rudder blades 4, 5 convert rotating energy of a propeller slip stream of the propeller 3, which rotatively streams rearward between both rudder blades 4, 5, into lift having a forward vectored component.

Accordingly, an increase in viscous pressure resistance at the fish tail trailing edge portion 20, 21 in the neutral position of the rudders when a ship goes straight ahead, and deteriorative tendency of a thrust deduction coefficient in a self-propulsion factor caused by two sheets of the rudders 4, 5 are compensated with the forward vectored thrust generated by the reaction fins 10, 11, and in addition, decrease in resistance by reduced rudder area, and thus propulsive efficiency comes to be equal with or higher than that of a conventional single rudder system.

Furthermore, by virtue of small sizes of the rudder blades 4, 5 and reduction in rudder area per a sheet of the rudders to the extent of about 28~35% of rudder area in the conventional single rudder system of Mariner type, including the horn 53, reduction of the rudder sizes produces such an economical effect as to enable hull length to shorten or stowage capacity to increase. Furthermore, as construction and weight per a rudder are remarkably lightened, compared with those in a conventional system, rudder manufacturing becomes easy, and it becomes possible to change a conventional way of rudder supporting system of Mariner type into a hanging rudder system of simple construction. Furthermore, as total required capacity for two steering gears is reduced to the extent of about 50% of that in a conventional single rudder system of Mariner type; namely, required capacity per a steering gear is reduced to the extent of about 25% of that in the conventional system, there is no necessity for employing such a steering gear of extra large capacity that requires specially manufacturing as used in the conventional system.

Furthermore, even if a rudder of one side or its steering gear got out of order, ship maneuvering capability can be maintained by remaining rudder, and thus safety is remarkably improved, compared with a case of a conventional single rudder system.

Figure 5:
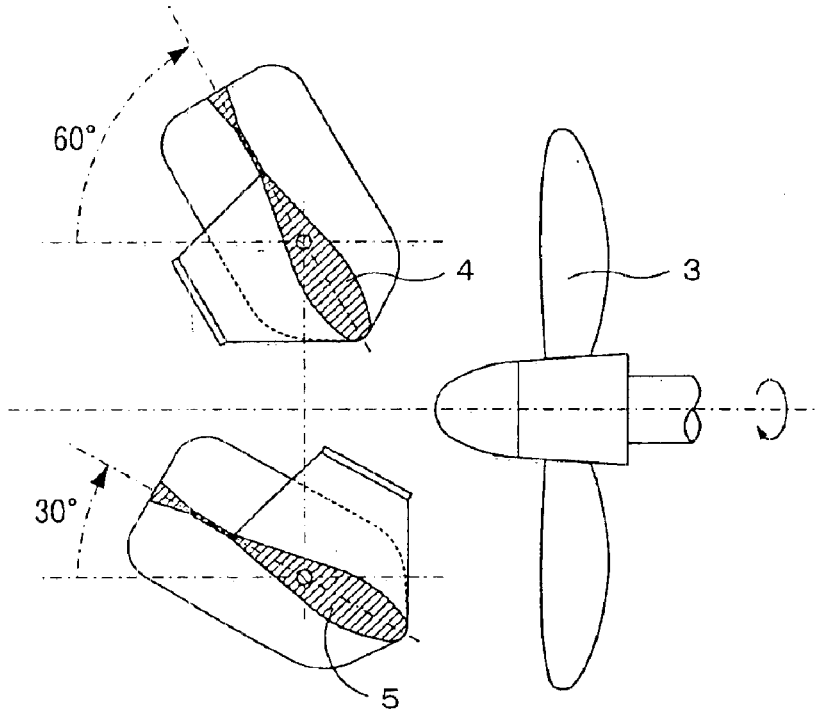
FIG. 5 shows an explanatory drawing showing operation in accordance with the same twin-rudder system for very large vessels.

In the mode for carrying out the present invention, the respective rudder blades 4, 5 can be turned toward outboard up to 60° for instance and toward inboard up to 30° for instance, and co-work of two rudders with the port rudder blade 4 being placed at 60° port and the starboard rudder blade 5 being placed at 30° port, for instance, as shown in FIG. 5, makes it possible to avoid mutual interfering action of a stream in the space between two rudder blades 4, 5, and thus it makes it possible for two rudders to generate rudder force effectively, and as a result, it makes it possible to turn a ship port with the utmost ability.

Figure 6:
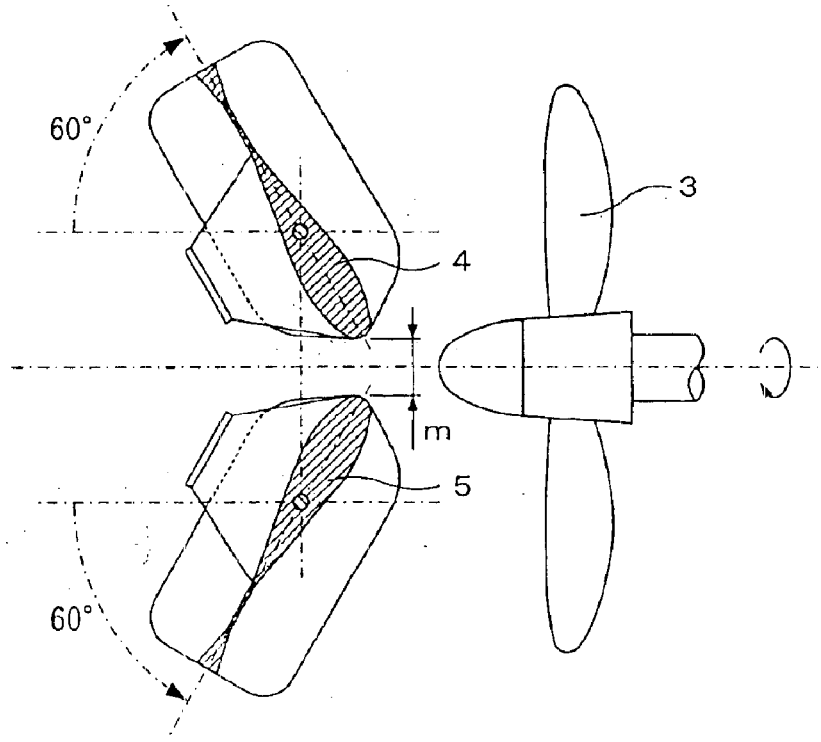
FIG. 6 shows an explanatory drawing showing operation in accordance with the same twin-rudder system for very large vessels.

Furthermore, when the respective rudder blades 4, 5 are turned toward outboard, the respective rudder blades 4, 5 generate lift and drag by a propeller slip stream of the propeller 3, and the lift is offset each other and the remaining drag decreases advance thrust by the propeller 3. Accordingly, it is possible to give a ship brake force and reduce ship speed without controlling revolution of the propeller 3. As its extremity, in a condition where the respective rudder blades 4, 5 are turned toward outboard to the maximum angle of 60°, respectively, as shown in FIG. 6, the respective rudder blades 4, 5 act as a brake against onward movement of a ship.

In addition, as the gap m between the tips of the leading edge portions 16, 17 of the respective rudder blades 4, 5 is quite small, and a runaway stream of a propeller slip stream of the propeller 3 passing through the gap rearward is small in quantity, advance thrust by the propeller 3 decreases and drag generated on the rudder blades 4, 5 becomes maximum, and thus it is possible to stop a ship quickly, and safety is remarkably improved.

Such a special character of turning the respective rudder blades 4, 5 toward outboard, respectively, as aforementioned can be utilized for making a ship navigate with extremely slow speed; namely, in case that a ship is propelled by a main prime mover of diesel engine and a propeller 3 is of fixed pitch type, it is unable to decrease the main diesel engine revolution lower than "dead slow" that is the lowest allowable revolution, and a considerably high undesirable ship speed remains, but in accordance with the present invention, by such a means that the respective rudder blades 4, 5 are turned toward outboard, and that their turned angles are controlled, drag generated on the rudder blades 4, 5 is controlled, and hereby advance thrust by the propeller 3 is offset, and thus it is possible to further decrease a ship speed beyond the speed corresponding to the main engine dead slow revolution.

Furthermore, as it is not necessary for steering gears to turn the rudders in both directions, port and starboard, with the same large angles, though the rudders 1, 2 are subject to large operable angle as aforementioned, it is advantageous that a required working angle range for the steering gears can be narrowed.

Figure 7:
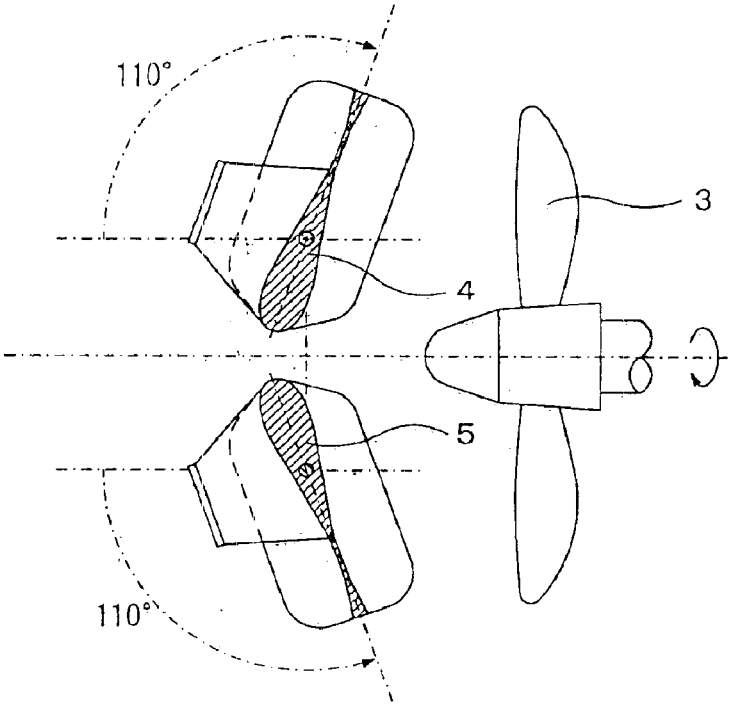
FIG. 7 shows an explanatory drawing showing operation in accordance with the same twin-rudder system for very large vessels.

Conversely speaking, if the maximum operable angle of the respective rudders 1, 2 toward outboard is increased more, using the maximum available working angle range of steering gears as far as possible, it is possible to further improve the aforementioned turning ability, changing head ability and stopping ability. For instance, in case of a rotary vane steering gear, it is easy to make the maximum working angle range 140°, and if, in this case, operable rudder angles of the respective rudder blades 4, 5 are made as 110° toward outboard and 30° toward inboard, for instance, the turning ability and changing head ability become superior, and at crash stopping maneuver, brake force is increased more due to increased protruding area of the respective rudder blades 4, 5 toward outboard, than those in case of the operable rudder angles of 60° toward outboard and 30° toward inboard instanced in the aforementioned mode for carrying out the present invention. Furthermore, as shown in FIG. 7, at the rudder angle of 110°, the brake force becomes stronger as astern power is also generated.

Furthermore, by virtue of co-workability of two rudders 1, 2, a degree of freedom for controlling direction of a propeller slip stream of the propeller 3 becomes high, and thus it becomes possible to further improve maneuverability. The following maneuver, for instance, becomes possible, though it depends on an attribute of ship, with the propeller 3 being kept running ahead in either case. Namely, if the port rudder 1 is positioned at around 75° port and the starboard rudder 2 at around 75° starboard, it is possible to make a ship hover nearly in situ since drag generated on the rudders 1, 2 nearly stands against advance force by the propeller 3, and lift generated on the rudders 1, 2 is offset each other bilaterally. If the port rudder 1 is positioned at around 70° port and the starboard rudder 2 at around 25° starboard, it is possible to make the ship's bow rotate left, with advance of a ship being restrained. If the port rudder 1 is positioned at around 110° port and the starboard rudder 2 at around 65° starboard, it is possible to make the ship's stern rotate port, with a ship going astern slowly. Furthermore, if the port rudder 1 is positioned at around 110° port and the starboard rudder 2 at around 75° starboard, it is possible to make the ship's stern turn port, with ship's going astern speed being increased.

Figure 8:
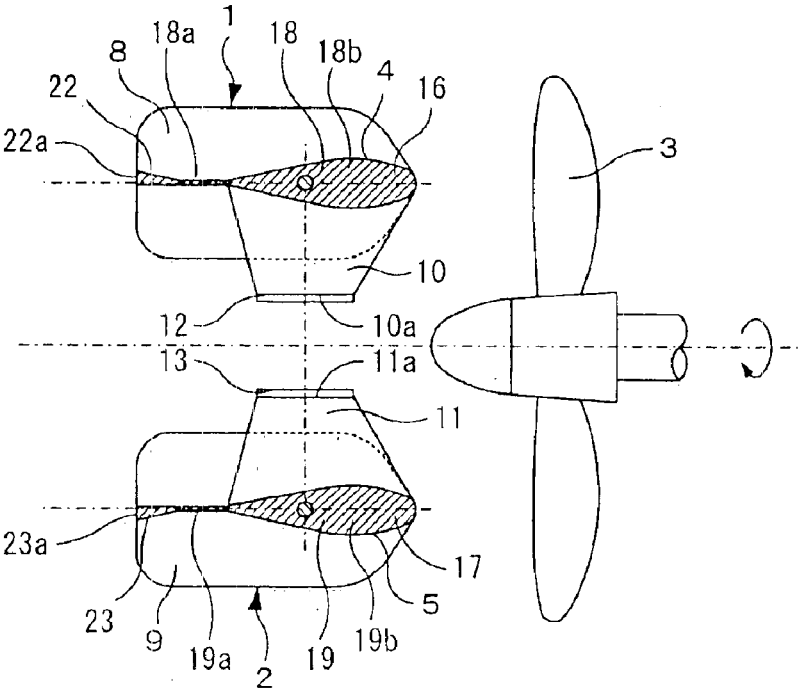
FIG. 8 shows a partially sectioned plan view of a twin-rudder system for very large vessels in accordance with another mode for carrying out the present invention.

FIG. 8 shows another mode for carrying out the present invention. Regarding the members that basically act similar to the arts explained in FIG. 1~FIG. 4, explanation is omitted, with the same numbers being affixed.

As shown in FIG. 8, in a horizontal sectional profile of both rudder blades 4, 5, respective fish tail trailing edge portions 22, 23 continuous with the mid body portions 18, 19 have such shape as to gradually increase their width, only unilaterally to outboard side, toward rear end faces 22*a*, 23*a* having a fixed width.

Thanks to this constitution in accordance with the present invention, it is possible, in the neutral position of the rudders when a ship goes straight ahead, to reduce viscous pressure resistance caused by a stream at the fish tail trailing edge portions 22, 23 by half, and improve propulsive efficiency.

On the other hand, decrease of lift generation at the fish tail trailing edge portions 22, 23 can be restrained to the minimum as a whole by virtue of the matter that stream deflecting action by the fish tail trailing edge portions 22, 23 is performed on the outboard side with emphasis where such action is more effectively performed, in view of such structure that operable rudder angles of the respective rudders 1, 2 toward outboard are made larger than those toward inboard, and thus it is possible to still exhibit excellent maneuverability; namely, superior course keeping quality, turning ability, changing head ability and stopping ability, than a case of a conventional single rudder system.

Figure 9:
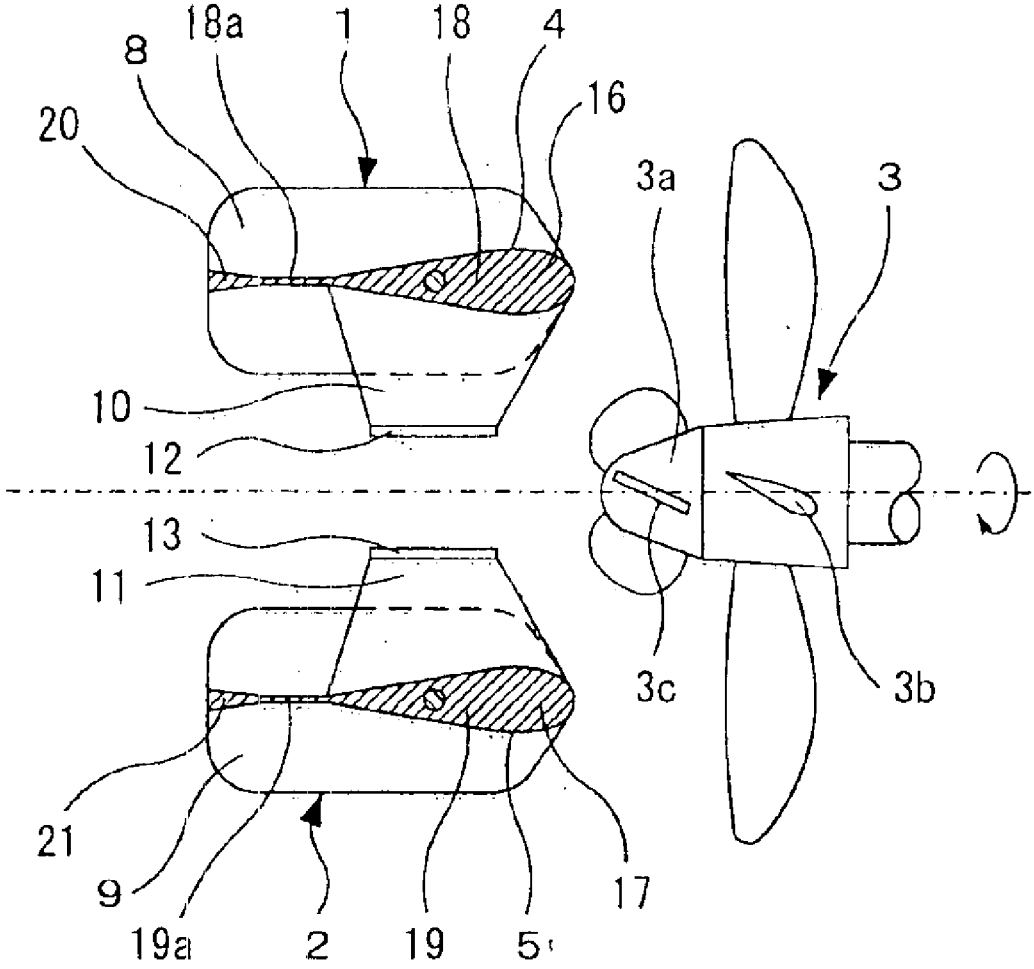
FIG. 9 shows a partially sectioned plan view of a twin-rudder system for very large vessels in an instance where propeller boss cap fins are appended to a propeller in accordance with the present invention.

FIG. 9 is a drawing showing a case where, in the mode for carrying out the present invention, fins 3*c* are appended on a propeller boss cap 3*a* of the propeller 3, so that they make the propeller boss cap 3*a* generate a stream in the same direction as a propeller slip stream generated by propeller blades 3*b*.

A propeller slip stream, which the propeller blades 3*b* produce, generate hub vortex at the central part of a flux of the propeller slip stream, and it acts as force that lowers advance force of the propeller 3, and hence propulsive efficiency becomes low to that extent. However, the fins 3*c* provided on the boss cap 3*a* of the propeller 3 create a stream even at the central part of a flux of the propeller slip stream made by the propeller blades 3*b*, and thus generation of hub vortex is restrained. Accordingly, a lowering of propulsive efficiency can be restrained.

In the conventional art, in which a rudder 51 exists behind a propeller 3 just at its center, the rudder 51 has an effect to restrain generation of hub vortex to some extent. On the other hand, in the mode for carrying out the present invention, in which there exists no rudder behind the propeller 3 just at its center, there is a condition susceptible to generation of hub vortex, and accordingly, effectiveness of restraining generation of hub vortex by providing the fins 3*c* on the boss cap 3*a* becomes significantly larger than that in case of the conventional art of a single rudder.

In order to prove the aforementioned respective effects in a twin-rudder system for very large vessels in accordance with the present invention, tank tests by model ships have been carried out, and in addition, computer simulation on motion of a typical very large crude oil carrier has been carried out based on tank test data. Furthermore, a fine tank test for propulsive performance has also been carried out using a large model ship that has ship form close to actual standard ship form of very large crude oil carriers. Results of these are explained in the following.

(1) Test by Model Ship

Using a model ship with a length of 4 m, a tank test has been carried out. The test has been based on specifications shown in FIG. 10, and in a manner that a conventional single rudder of Mariner type and a twin-rudder system in accordance with mode for carrying out the present invention are both compared.

Figure 11:
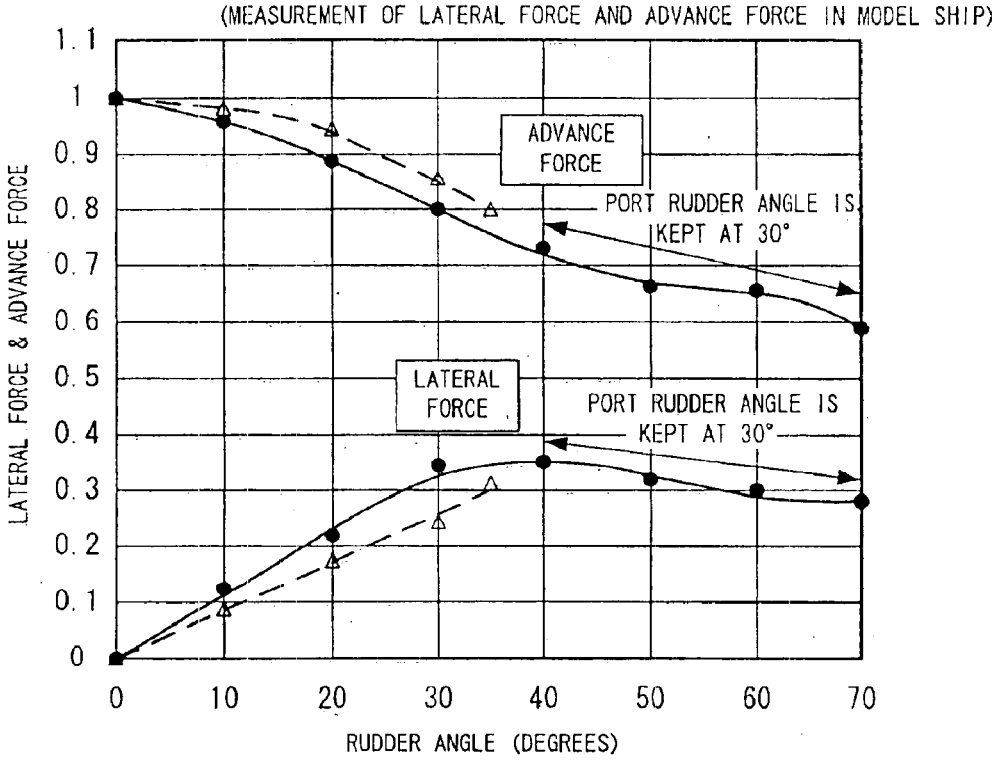
FIG. 11 shows a graph illustrating a test result by the model ship with respect to measurement of lateral force and advance force about the twin-rudder system for very large vessels in accordance with the present invention.

Indexes of various maneuvering ability of a ship are indicated by magnitude of lateral force acting on a rudder and advance force acting on a ship when the rudder(s) is(are) given angle(s) under a condition that a propeller is running, and that propulsive performance of a ship when she goes straight ahead is indicated by magnitude of advance force acting on her in the neutral position of the rudder(s), and hence these values have been measured in the tank test. Results of the test are shown in FIG. 11. Further added is that magnitude of respective force is expressed with non-dimensional figures, that is, with the ratio to 1.0 that represents magnitude of propeller thrust on the occasion when the ship is bound to a bollard and the propeller is operated.

As is seen from FIG. 11, the twin-rudder system in accordance with the present invention is more in lateral force and less in advance force at all rudder angles, excluding in the neutral position of the rudders, than the conventional single rudder of Mariner type; namely, when rudder angles are given, ship speed is more reduced and force laterally pushing the ship stern is stronger, and the force is continuously produced at larger rudder angles than 35°.

In the light of these results, it has been proved that the twin-rudder system in accordance with the present invention is superior to the conventional single rudder of Mariner type in ship's maneuverability. In addition, as for advance force in the neutral position of the rudder(s), meaningful difference between both is not recognized, and thus it can be said that the twin-rudder system in accordance with the present invention has equal propulsive performance with the conventional single rudder of Mariner type.

(2) Computer Simulation on Ship Motion

Based on the data obtained at the aforementioned tank test, computer simulation has been carried out on ship's turning motion and motion at a 10°/10° zigzag maneuver test for a typical very large crude oil carrier. Results are shown in FIG. 12~FIG. 13.

Figure 12:
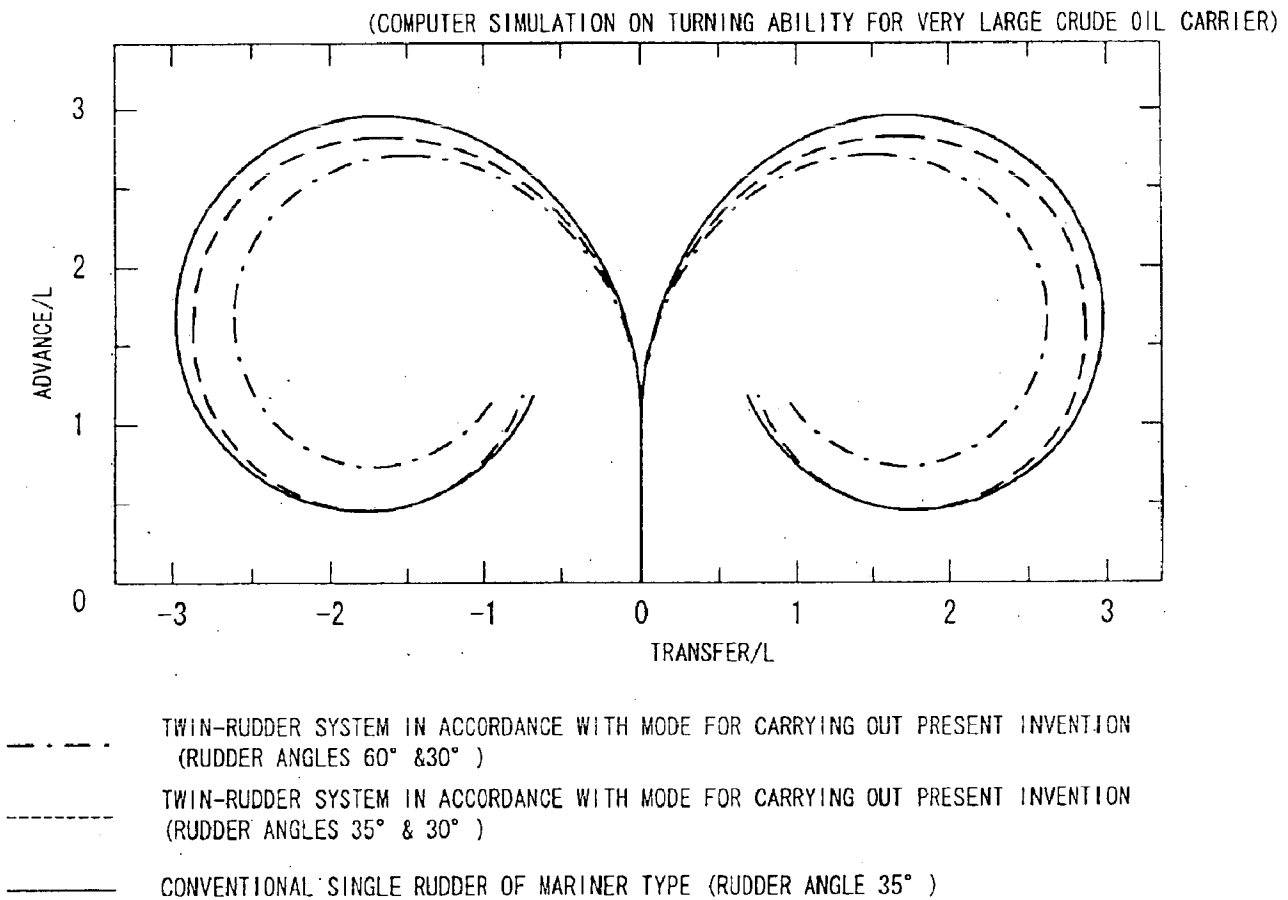
FIG. 12 shows a graph illustrating a result of computer simulation on turning ability of a very large crude oil carrier, to which a twin-rudder system for very large vessels in accordance with the present invention is applied.

As is seen from FIG. 12, it has been proved that the twin-rudder system in accordance with the mode for carrying out the present invention is superior to the conventional single rudder of Mariner type in every figure of tactical diameter, advance and transfer in ship's turning.

Figure 13:
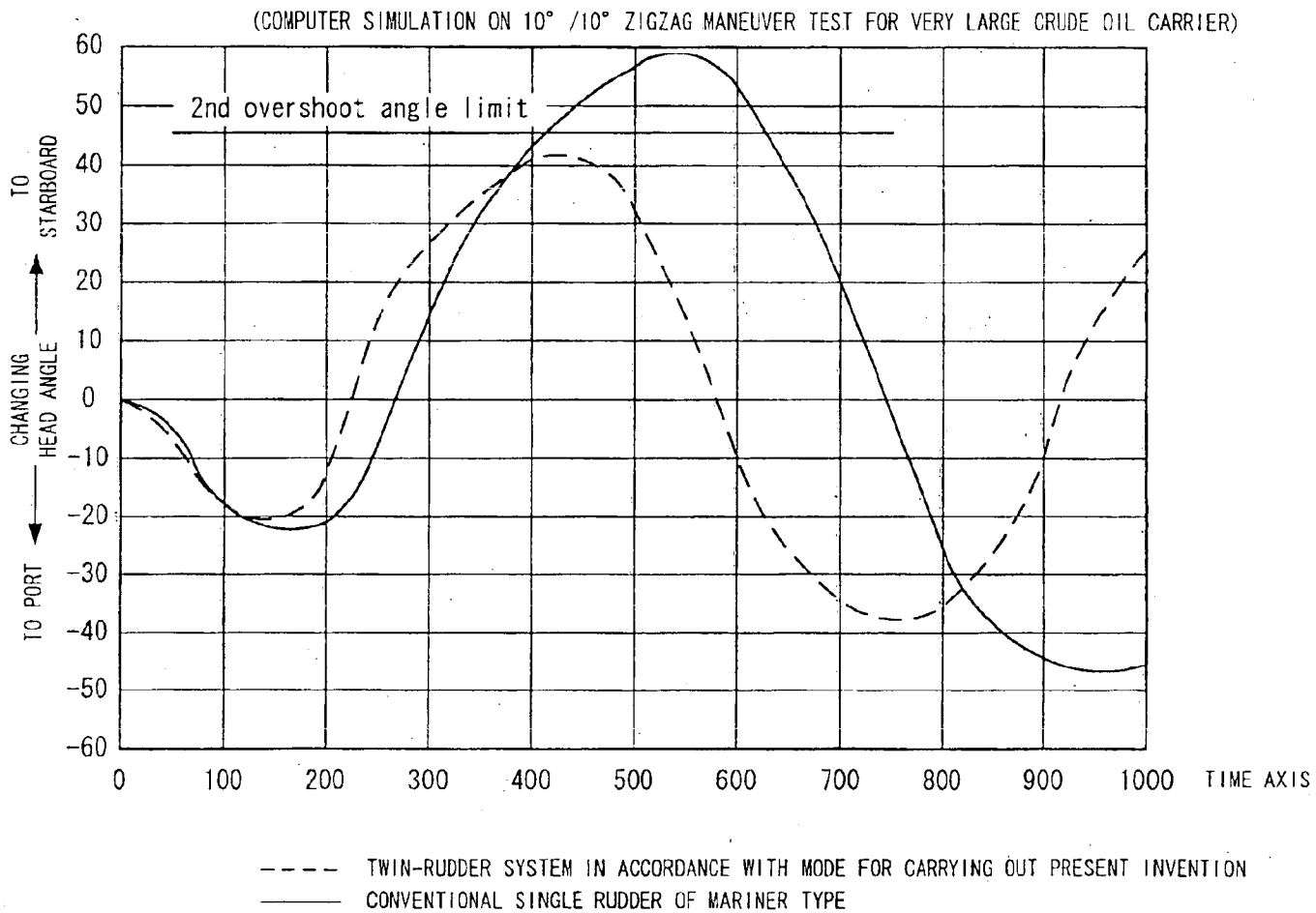
FIG. 13 shows a graph illustrating a result of computer simulation on 10°/10° zigzag test for a very large crude oil carrier, to which a twin-rudder system for very large vessels in accordance with the present invention is applied.

Furthermore, as is seen from FIG. 13, it has been proved that the twin-rudder system in accordance with the mode for carrying out the present invention is much superior to the conventional single rudder of Mariner type, especially in the second overshoot angle that is at issue, at the 10°/10° zigzag maneuver test.

(3) Tank Test Using Ship Form of Very Large Crude Oil Carrier

In order to more finely examine propulsive performance in case of applying the mode for carrying out the present invention to very large crude oil carriers, a tank test has been carried out, using a model ship with a length of 7 m that had been already prepared as having a single rudder, and having ship form close to actual standard ship form of very large crude oil carriers of 300,000 DWT class. Specifications of the very large crude oil carrier and her rudder subject to the test are as shown in FIG. 14. Propulsive performance tests have been carried out, using the same model ship, for two cases, respectively; namely, a case where a conventional single rudder of Mariner type is equipped, and a case where a twin-rudder system in accordance with the mode for carrying out the present invention is equipped, and both have been compared.

Figure 15:
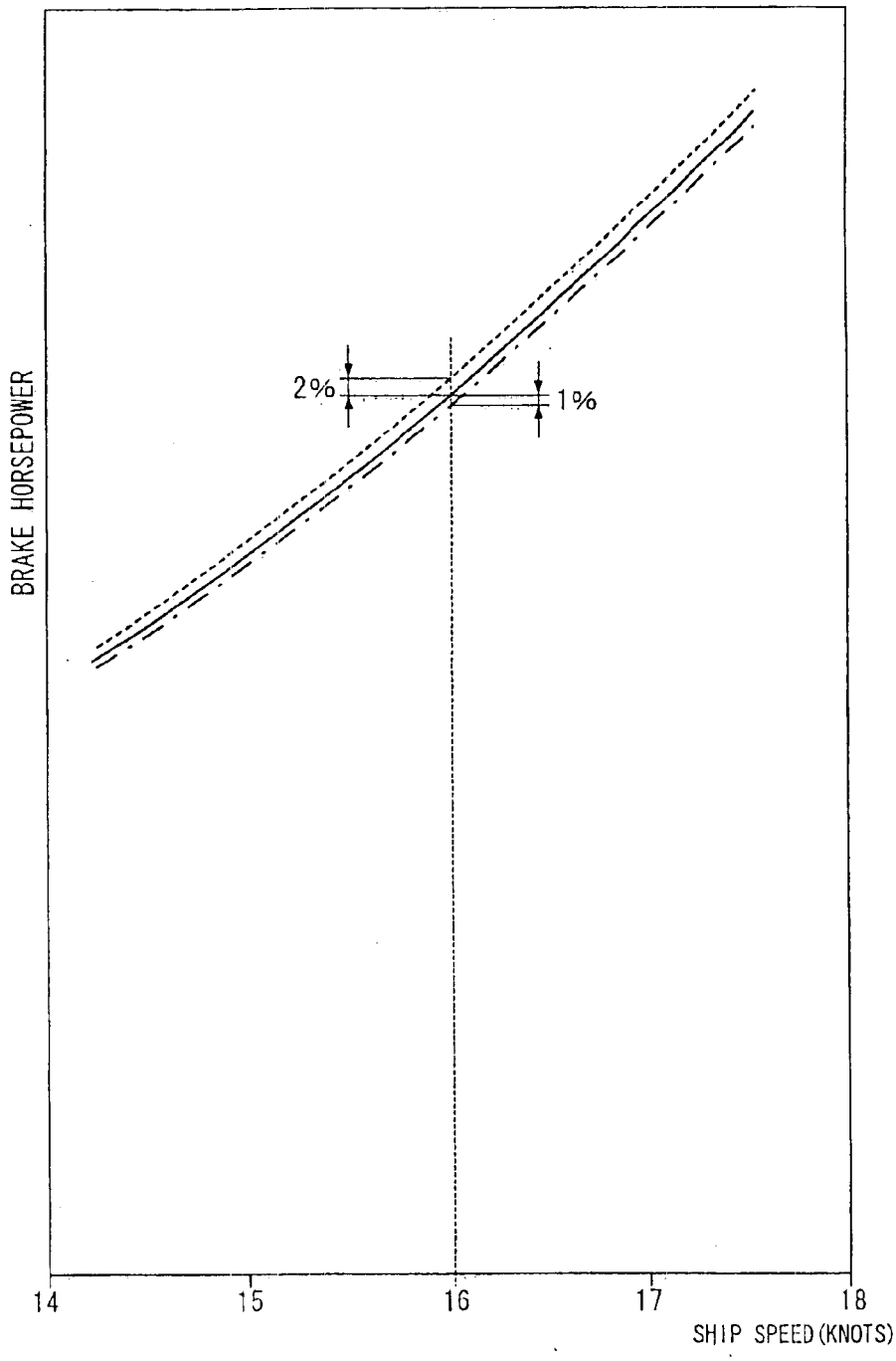
FIG. 15 shows a graph illustrating a result of a propulsive performance test by the model of the very large crude oil carrier with respect to the twin-rudder system for very large vessels in accordance with the present invention.

FIG. 15 shows a diagram, in which required brake horsepower calculated from measured values at the tests, are plotted. According to this, the test results are that, at sea speed of 16 knots, the case of twin-rudder system in accordance with the mode for carrying out the present invention requires about 2% more brake horsepower than the case of conventional single rudder of Mariner type.

It is necessary, however, to make modifications against the matter that the test has been carried out in such a manner that the twin-rudder system was fitted on the model ship, with the ship stem form, which was for a single rudder, being left as it was, and modifications of rudder design so as to be in conformity with behavior of a stream around the ship stem and the propeller that has become clear as a result of the test; for instance, modifications on rudders' sectional profile, modifications on the top and bottom end plates in terms of rake angle and area, modifications on the interval of the axes of two rudders, etc. Among other things, it is definite that reducing size of the skegs that is compelled to have been extremely large, as is understood from FIG. 14, is necessary.

In this test, measures have been taken, for the present, to reduce resistance of the so large skegs by means of raking the respective skegs toward inboard as much as 2°.

Furthermore, in an actual ship, it is common practice that fins are attached to a propeller boss cap to improve propulsive efficiency, dissolving loss caused by hub vortex of a propeller, though such fins have not been attached in this model ship test. In the case of attaching such fins, it is known that degree of improvement in propulsive efficiency in case of a single propeller—twin-rudder system is larger as much as 3% or more at the minimum than in case of a single rudder.

If the aforementioned modifications were added to the results of the tests for the twin-rudder system in accordance with the mode for carrying out the present invention, it is anticipated that an actual figure of propulsive efficiency is higher as much as 3% or more at the minimum than the figure in the test results, and thus it is anticipated that propulsive efficiency becomes higher as much as about 1% or more than that in case of a conventional single rudder of Mariner type. In addition, taking into consideration the reduction in resistance by skeg size reductions and optimization of the aforementioned items, it is anticipated that this difference becomes larger.

As mentioned above and understood from FIG. 11, FIG. 12~FIG. 13 and FIG. 15, such test results and computer simulation results have been obtained that the twin-rudder system in accordance with the mode for carrying out the present invention exhibits, despite extremely small sizes of the rudders, higher maneuverability by virtue of excellence in terms of lateral force and advance force when rudder angles are given, and that it gives nearly same or less propulsive resistance and has nearly equal or higher propulsive performance when a ship goes straight ahead than a conventional single rudder of Mariner type.

In the next place, thanks to the actual proofs of effect of the present invention by the tank tests and the computer simulation, trial design has been carried out in the case of applying the present invention to a very large crude oil carrier of 300,000 DWT class that is to satisfy the IMO (International Maritime Organization) requirements for maneuvering performance, in the form of comparing it with a case of a conventional rudder system. The results are shown in FIG. 16.

Hereby it has been proved that, in a very large crude oil carrier of 300,000 DWT class, to which a twin-rudder system of the present invention is applied, whole rudder area decreases to about 77%, for only movable portions, of, and whole rudder torque, namely whole required capacity for steering gears decreases to about 50% of that in the case a conventional single rudder of Mariner type is applied.

Figure 17:
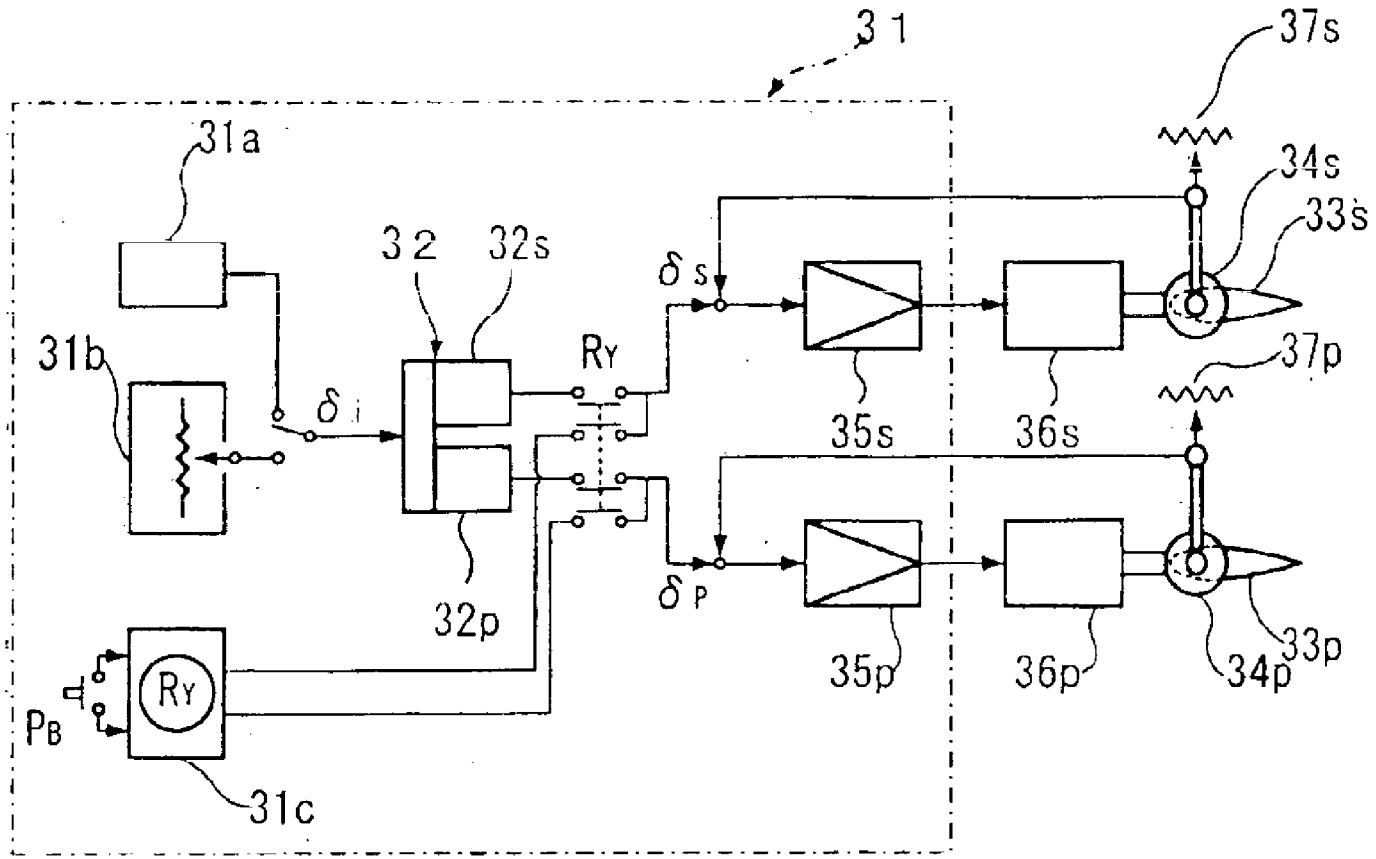
FIG. 17 shows an explanatory drawing of a circuit of a rudder angle control system for twin rudders in accordance with the mode for carrying out the present invention.

FIG. 17 shows a rudder angle control system in the mode for carrying out the present invention, and the rudder angle control system consists of an auto-pilot 31, a port steering gear 34*p* that operates a port rudder 33*p*, a starboard steering gear 34*s* that operates a starboard rudder 33*s*, a port hydraulic pump unit 36*p* that operates the port steering gear 34*p*, and a starboard hydraulic pump unit 36*s* that operates the starboard steering gear 34*s*. The port rudder 33*p* and the starboard rudder 33*s* are so constituted as to be operable up to the maximum outboard operable angle $\delta_M$ toward outboard and the maximum inboard operable angle $\delta_T$, which is smaller than $\delta_M$, toward inboard, respectively.

The auto-pilot 31 that makes a rudder angle control system is composed of an automatic steering apparatus 31*a*, a steering wheel 31*b*, a rudder angle control operation for crash astern 31*c*, a port rudder angle control operation 32*p* and a port control amplifier 35*p* that control operation of the port steering gear 34*p*, and a starboard rudder angle control operation 32*s* and a starboard control amplifier 35*s* that control operation of the starboard steering gear 34*s*, and that the port rudder angle control operation 32*p* and the starboard rudder angle control operation 32*s* make a rudder angle control operation 32.

A port rudder angle feedback controller 37*p* detects an actual turning amount of the port rudder 33*p*, and feeds it back to the port control amplifier 35*p*, and a starboard rudder angle feedback controller 37*s* detects an actual turning amount of the starboard rudder 33*s*, and feeds it back to the starboard control amplifier 35*s*. The port rudder 33*p* and the starboard rudder 33*s* are so constructed as to be able to be turned up to the maximum outboard operable angle $\delta_M$ toward outboard, and up to the maximum inboard operable angle $\delta_T$, which is smaller than $\delta_M$, toward inboard, respectively. Setting of the maximum outboard operable angle $\delta_M$ and the maximum inboard operable angle $\delta_T$ can be made by the port rudder angle control operation 32*p* and the starboard rudder angle control operation 32*s*, instead of being controlled by construction of the port rudder 33*p* and the starboard rudder 33*s*.

The port rudder angle control operation 32*p* and the starboard rudder angle control operation 32*s* of the rudder angle control operation 32 have a function circuit, respectively, that outputs a port control signal $\delta_p$ and a starboard control signal $\delta_s$, which consist of a function $f(\delta_i)$, a variable of which is a rudder angle order signal $\delta_i$ issued by the automatic steering apparatus 31*a* or the steering wheel 31*b* of the auto-pilot 31, and gives the signals to the port control amplifier 35*p* and the starboard control amplifier 35*s*, respectively.

Figure 18:
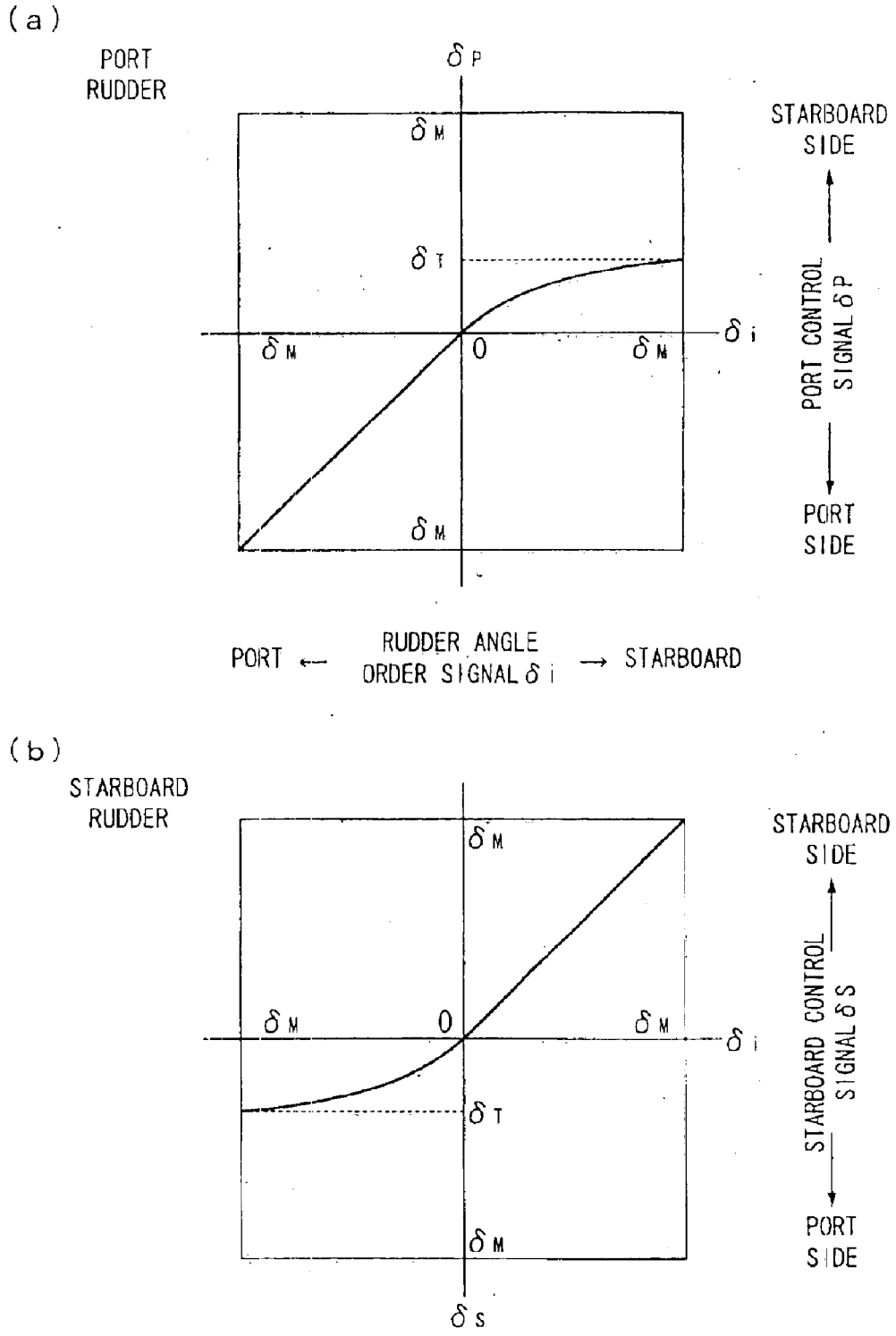
FIG. 18 shows a chart illustrating the relationship between a rudder angle order signal and steered amount of respective rudders at turning maneuver in the Operation Example 1 of a rudder angle control system in accordance with the present invention.

The function $f(\delta_i)$ differs according to rudder type, ship stern construction, etc., and is set so as to become an optimum functional formula. For instance, from the viewpoint that, when the port rudder 33*p* and the starboard rudder 33*s* are turned toward a same board side, the rudders should be operated so that rudder force can be effectively produced by such a means that less extent of influence of mutual interfering action of a deflected propeller slip stream between two rudders is exerted upon both rudders, and that rudder angle is as large as possible, in case of helm order to port, a port control signal $\delta_p$ given to the port rudder 33*p* is equalized to a rudder angle order signal $\delta_i$ up to the maximum outboard operable angle $\delta_M$, and a starboard control signal $\delta_s$ given to the starboard rudder 33*s* is made as $\delta_s=\delta_i-(\delta_M-\delta_T)\delta_i^2/\delta_M^{2\square}$ up to the maximum inboard operable angle $\delta_T$. On the other hand, in case of helm order to starboard, a port control signal $\delta_p$ given to the port rudder 33*p* is made as $\delta_p=\delta_i-(\delta_M-\delta_T)\delta_i^2/\delta_M^{2\square}$ up to the maximum inboard operable angle $\delta_T$, and a starboard control signal $\delta_s$ given to the starboard rudder 33*s* is equalized to a rudder angle order signal $\delta_i$ up to the maximum outboard operable angle $\delta_M$. This relation is shown in a graph in FIG. 18.

The rudder angle control operation for crash astern 31*c* of the auto-pilot 31 has a function circuit that gives the port control amplifier 35*p* such an order signal that the port rudder 33*p* is turned port to the maximum outboard operable angle $\delta_M$, and gives the starboard control amplifier 35*s* such an order signal that the starboard rudder 33*s* is turned starboard to the maximum outboard operable angle $\delta_M$.

Furthermore, a crash stopping push button $P_B$ of the rudder angle control operation for crash astern 31*c* has a function circuit that, when the push button $P_B$ is on, automatically shuts off, by a relay $R_Y$, input signals to the port control amplifier 35*p* and the starboard control amplifier 35*s* issued by the automatic steering apparatus 31*a* or the steering wheel 31*b* of the auto-pilot 31.

In the following, action of the aforementioned constitution is explained. First, turning or changing head maneuver of a ship is explained.

OPERATION EXAMPLE 1

When putting the helm to port, for instance, such a rudder angle order signal $\delta_i$ is issued by the automatic steering apparatus 31*a* or the steering wheel 31*b* of the auto-pilot 31.

On this occasion, with respect to operation of the port rudder 33*p*, such a port control signal $\delta_p$ as equal to a rudder angle order signal $\delta_i$ is given to the port control amplifier 35*p* from the port rudder angle control operation 32*p*. The port control amplifier 35*p* operates the port rudder 33*p* in the port direction by controlling the port hydraulic pump unit 36*p* so as to operate the port steering gear 34*p*. An actual moving amount of the port rudder 33*p* is detected by the port rudder angle feedback controller 37*p* and fed back to the port control amplifier 35*p*. When the amount fed back comes to equal to the port control signal $\delta_p$, the port control amplifier 35*p* makes operation of the port hydraulic pump unit 36*p* stop. By this operation the port rudder 33*p* is kept at the rudder angle that is equal to the rudder angle order signal $\delta_i$, and that at the angle not exceeding the maximum outboard operable angle $\delta_M$.

On the other hand, with respect to operation of the starboard rudder 33*s*, such a starboard control signal $\delta_s$ as $\delta_s=\delta_i-(\delta_M-\delta_T)\delta_i^2/\delta_M^2$ is given to the starboard control amplifier 35*s* from the starboard rudder angle control operation 32*s*. By the starboard control signal $\delta_s$, the starboard control amplifier 35*s*, the starboard hydraulic pump unit 36*s*, and the starboard steering gear 34*s* are operated in like manner, and the starboard rudder 33*s* is kept at the rudder angle that is equal to the starboard control signal $\delta_s$, namely, at the smaller rudder angle than the rudder angle of the port rudder 33*p*, and at the angle not exceeding the maximum inboard operable angle $\delta_T$.

Accordingly, such an angle difference as $\Delta=\delta_p-\delta_s=(\delta_M-\delta_T)\delta_i^2/\delta_M^2$ exists between the port rudder 33*p* and the starboard rudder 33*s*, and as a result, it is possible to avoid mutual interfering action of a deflected propeller slip stream that streams between the port rudder 33*p* and the starboard rudder 33*s*, and make two rudders effectively generate rudder force, respectively.

When a rudder angle order signal $\delta_i$ is issued in the starboard direction, like action is exerted, only with left and right being opposite. Accordingly, explanation is omitted.

OPERATION EXAMPLE 2

In view that, within the range of comparatively small rudder angle, influence of mutual interfering action of a deflected propeller slip stream that streams between two rudders is small, functional operation of control signals $\delta_p$, $\delta_s$ in the rudder angle control operations 32*p*, 32*s* can be simplified.

For instance, when putting the helm to port, the port rudder 33*p* is so controlled that such a port control signals $\delta_p$ as equal to a rudder angle order signal $\delta_i$ is given within the range up to the maximum outboard operable angle $\delta_M$, and the starboard rudder 33*s* is so controlled that such a starboard control signal $\delta_s$ as $\delta_s=\delta_i$ is given within the range that a rudder angle order signal $\delta_i$ is smaller than the maximum inboard operable angle $\delta_T$, and such a starboard control signal $\delta_s$ as $\delta_s=\delta_T$(constant) is given within the range that a rudder angle order signal $\delta_i$ is larger than the maximum inboard operable angle $\delta_T$.

Figure 19:
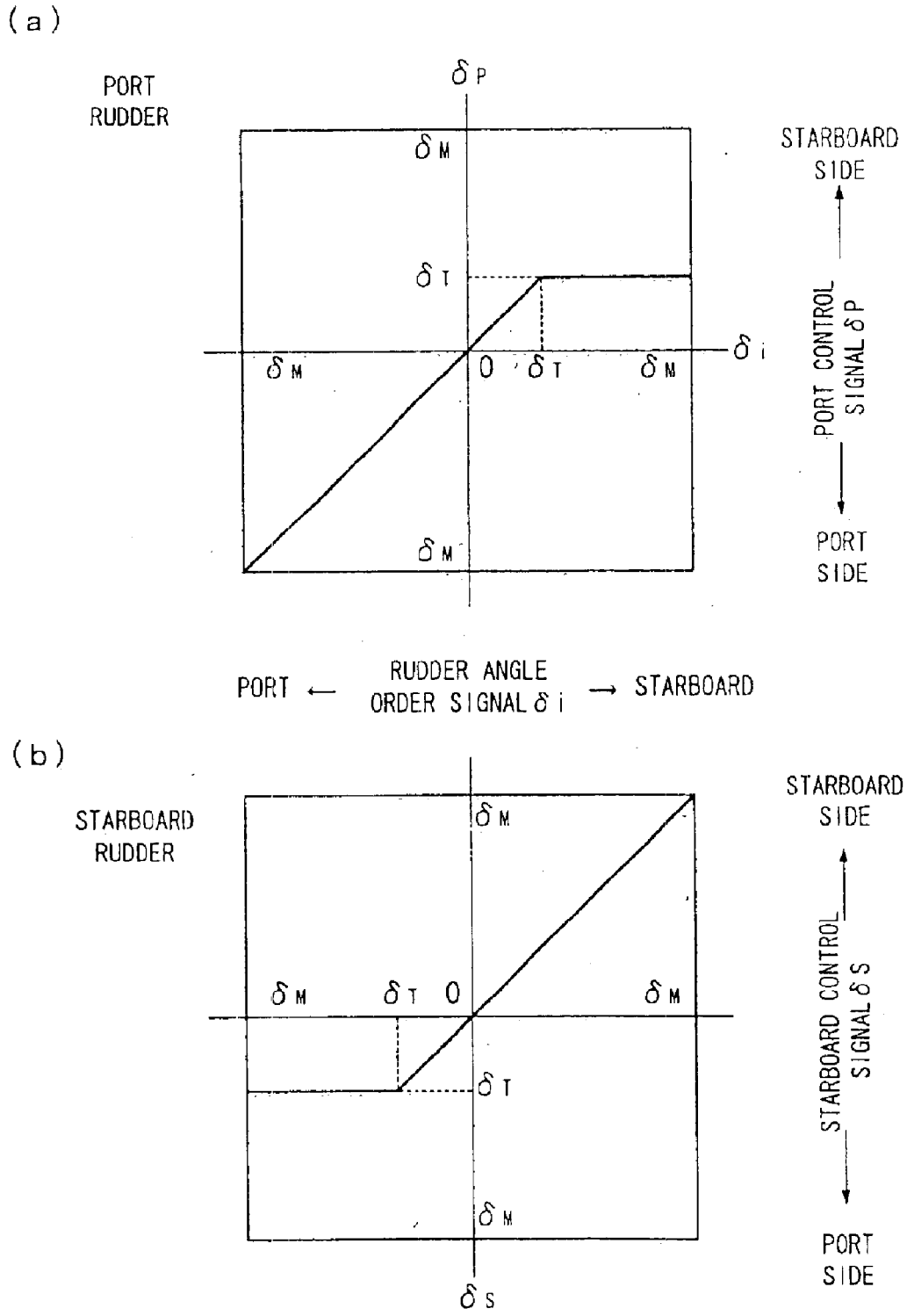
FIG. 19 shows a chart illustrating the relationship between a rudder angle order signal and steered amount of respective rudders at turning maneuver in the Operation Example 2 of a rudder angle control system in accordance with the present invention.

On the other hand, when putting the helm to starboard, the port rudder 33*p* is so controlled that such a port control signals $\delta_p$ as $\delta_p=\delta_i$ is given within the range that a rudder angle order signal $\delta_i$ is smaller than the maximum inboard operable angle $\delta_T$, and such a port control signal $\delta_p$ as $\delta_p=\delta_T$(constant) is given within the range that a rudder angle order signal $\delta_i$ is larger than the maximum inboard operable angle $\delta_T$. And the starboard rudder 33*s* is so controlled that such a starboard control signal $\delta_s$ as equal to a rudder angle order signal $\delta_i$ is given within the range up to the maximum outboard operable angle $\delta_M$. This relation is shown in a graph in FIG. 19.

In the abovementioned operation, there is no angle difference between the port rudder 33*p* and the starboard rudder 33*s* within the range of smaller rudder angle than the maximum inboard operable angle $\delta_T$, and there exists such angle difference as $\Delta=\delta_p-\delta_s=\delta_i-\delta_T$ in the larger rudder angle range than that, and thus influence of mutual interfering action of a stream between two rudders 33*p*, 33*s* increases a little in the comparatively small rudder angle range, but it is possible to further simplify constitution of the rudder angle control operations 32*p*, 32*s*.

Next, action in case of carrying out crash stopping of a ship is explained.

OPERATION EXAMPLE 3

In case of making a ship crash stop, the crash astern maneuvering mode is activated. In the crash astern maneuver, the crash stopping push button $P_B$ of the rudder angle control operation for crash astern 31*c* of the auto-pilot 31 is pushed at the time when fuel supply to a main engine running ahead has been shut down, and hereby input signals to the port control amplifier 35*p* and the starboard control amplifier 35*s* issued from the automatic steering apparatus 31*a* or the steering wheel 31*b* are automatically shut off, and the port and starboard control amplifiers 35*p*, 35*s* are placed under control of the rudder angle control operation for crash astern 31*c* by action of the relay $R_Y$.

The rudder angle control operation for crash astern 31*c* issues a control signal to the port control amplifier 35*p* so as to make the port rudder 33*p* turn hard port, and issues a control signal to the starboard control amplifier 35*s* so as to make the starboard rudder 33*s* turn hard starboard. When actual rudder angles of the port and starboard rudders 33*p*, 33*s* have reached the positions hard port and hard starboard, respectively, the port and starboard control amplifiers 35*p*, 35*s* receive the respective rudder angle feedback signals, and make the operation of the port and starboard hydraulic pump units 36*p*, 36*s* stop, and thus the port and starboard rudders 33*p*, 33*s* are kept at the rudder angles hard port and hard starboard, respectively.

Under this condition, the port and starboard rudders 33*p*, 33*s* generate large brake force against onward movement of a ship by inertia, and thus quickly reduce ship advance speed, and at the same time, quickly reduce propeller idling speed up to the revolution, at which propeller reversing operation or engagement of a reversing clutch of a reduction gear becomes possible. Accordingly, it is possible for a ship to be transferred to astern maneuver in a short time after the crash astern maneuver mode for making a ship quickly stop has been initiated, and thus it is possible to greatly shorten run-by-inertia distance of a ship. Accordingly, it is possible to decrease risk of collision of a ship in the meantime to a great extent, and remarkably lighten the labors imposed on ship's crew for avoiding the risk.

In this context, the rudder angle control operation for crash astern 31*c* of the auto-pilot 31 is separated from the control system at the time when a ship comes to stop from advancing by inertia after reversing operation of a propeller, and usually, control is transferred to the steering wheel 31*b* for controlling the port and starboard rudders 33*p*, 33*s*.

OPERATION EXAMPLE 4

Figure 20:
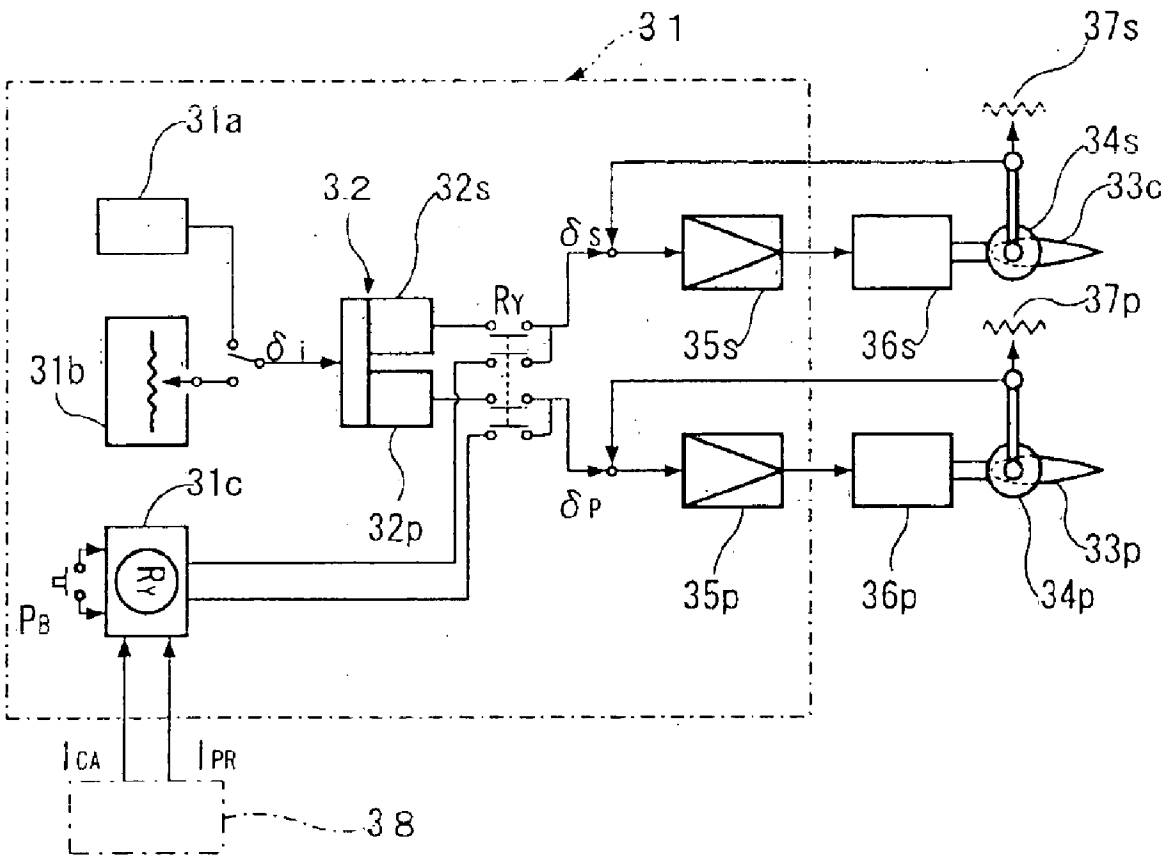
FIG. 20 shows an explanatory drawing of a circuit of a rudder angle control system for twin rudders in accordance with another mode for carrying out the present invention.

FIG. 20 shows another mode for carrying out the present invention. In FIG. 20, the rudder angle control operation for crash astern 31*c* is connected with signal lines from a main engine control system 38, which are for inputting a main engine control signal and the definite time elapse after the control has been transferred to reversing operation of a propeller by a timer (illustration is omitted). When a crash astern maneuvering mode has been activated, a signal $I_{CA}$ indicating fuel supply shut-off to the main engine issued by the main engine control system 38, and a signal $I_{PR}$ indicating the definite time elapse after starting propeller reversing operation, issued by a timer, are input into the rudder angle control operation for crash astern 31*c* through the signal lines.

Thanks to the aforementioned constitution, when a ship has been in a crash astern maneuvering mode, the input signals to the port control amplifier 35*p* and the starboard control amplifier 35*s* issued from the automatic steering apparatus 31*a* or the steering wheel 31*b* are automatically shut off by means of the relay $R_Y$, receiving the signal $I_{CA}$, and the port and starboard control amplifiers 35*p*, 35*s* are placed under control of the rudder angle control operation for crash astern 31*c*. Thereafter the port and starboard rudders 33*p*, 33*s* are operated in the same manner as explained in the aforementioned Operation Example 3, and turned to hard port and hard starboard, respectively, giving the ship brake force against onward movement by inertia. When ship control is transferred to astern maneuvering mode, and advance of the ship has come to stop, such control is automatically carried out, receiving the signal $I_{PR}$, that the control by the rudder angle control operation 31*c* of the auto-pilot 31 is shut off, and control by the steering wheel 31*b* is activated.

Effect of the Invention

In accordance with the present invention as aforementioned, with such constitution that two high lift rudders, in which chord length of the rudder blade is made as about a half of a propeller diameter so that a propeller slip stream can be effectively utilized, are arranged behind a single propeller, and that respective rudder angles are controlled so that they can co-work most effectively, such a rudder system for very large vessels can be offered that excellent maneuverability, namely course keeping quality, turning ability, changing head ability and stopping ability can be given not only at high speed navigation, but also at low speed navigation; nevertheless propulsive performance equal with or higher than that of a conventional single rudder system can be secured; such economical effect as the reduction of ship length or increase of stowage capacity due to shortened rudder sizes can be produced; rudder construction can be lightened; required capacity for steering gears can be reduced; and ship maneuvering ability can be secured with safety even in case that something has been wrong with either of the rudders or its steering gear.

For instance, in the case of applying a twin-rudder system for very large vessels in accordance with the present invention to a very large crude oil carrier that is to satisfy the IMO (International Maritime Organization) requirements for maneuvering performance, whole rudder area decreases to the extent of about 60~80% of, and whole rudder torque, namely whole required capacity for steering gears, decreases to the extent of about 50% of that in the case a conventional single rudder of Mariner type is applied. Nevertheless, distinguished effect is exhibited that ship's maneuverability is superior to, and propulsive performance can be equal with or higher than, that in case of a conventional single rudder system.

Furthermore, when a ship is in turning or changing head maneuver, two rudders can be controlled so that they can effectively generate rudder force without being influenced by mutual interfering action of a deflected propeller slip stream between two rudders, and a required working angle range for steering gears can be small. Furthermore, when a ship is in crash stopping (crash astern) maneuver, ship's running distance until she comes to stop can be remarkably shortened, with two rudders giving brake force against ship's onward movement by inertia.

Furthermore, even in case that a main prime mover is a diesel engine and a propeller is of fixed pitch, ship speed can be reduced as desired by means of two rudders to a level below the speed corresponding to the allowable lowest revolution (dead slow) of the main diesel engine, and that in the meantime ship's heading angle can be controlled.

We claim:

1. A twin-rudder system for very large vessels in a high lift twin-rudder system, said system comprising:

a single propeller having a propeller axis and a diameter;

a pair of high lift rudders arranged behind said single propeller nearly parallel in a symmetrical position against the propeller axis;

each high-lift rudder having a rudder blade having:

a blade chord length;

a top end plate and a bottom end plate;

a horizontal sectional profile having a forward protruding semicircular leading edge portion having a tip, a mid body portion continuative with the leading edge portion, said mid body portion increasing in width up to a maximum width portion in streamline shape, and then gradually decreasing in width toward the minimum width portion, and a fish tail trailing edge portion continuative with the mid body portion, said fish tail trailing edge portion gradually increasing in width laterally toward both boards or an outboard and terminating in a rear end face having a fixed width;

a reaction fin protruding from an inboard face of said rudder blade on generally the same level with the propeller axis, said reaction fin originating from about the leading edge portion of the rudder blade and extending toward the fish tail trailing edge portion, said reaction fin having a blade section having a fixed fin chord length;

wherein said blade chord length of each rudder blade is between 45 and 60% of said propeller diameter, and wherein fins are appended on a propeller boss cap for making the propeller boss cap generate a stream in the same direction as a propeller slip stream generated by propeller blades.

2. A twin-rudder system for very large vessels in a high lift twin-rudder system, said system comprising:

a single propeller having a propeller axis and a diameter;

a pair of high lift rudders arranged behind said single propeller nearly parallel in a symmetrical position against the propeller axis;

each high-lift rudder having a rudder blade having:

a blade chord length;

a top end plate and a bottom end plate;

a horizontal sectional profile having a forward protruding semicircular leading edge portion having a tip, a mid body portion continuative with the leading edge portion, said mid body portion increasing in width up to a maximum width portion in streamline shape, and then gradually decreasing in width toward the minimum width portion, and a fish tail trailing edge portion continuative with the mid body portion, said fish tail trailing edge portion gradually increasing in width laterally toward both boards or an outboard and terminating in a rear end face having a fixed width;

a reaction fin protruding from an inboard face of said rudder blade on generally the same level with the propeller axis, said reaction fin originating from about the leading edge portion of the rudder blade and extending toward the fish tail trailing edge portion, said reaction fin having a blade section having a fixed fin chord length;

wherein said blade chord length of each rudder blade is between 45 and 60% of said propeller diameter, and wherein said rudders have operating steering gears, and said system further comprises an auto-pilot for controlling rudder angles of the respective rudders, said auto-pilot having a control function operating the respective rudders wherein the maximum outboard operable angle is larger than the maximum inboard operable angle.

3. A twin-rudder system for very large vessels in a high lift twin-rudder system, said system comprising:

a single propeller having a propeller axis and a diameter;

a pair of high lift rudders arranged behind said single propeller nearly parallel in a symmetrical position against the propeller axis;

each high-lift rudder having a rudder blade having:

a blade chord length;

a top end plate and a bottom end plate;

a horizontal sectional profile having a forward protruding semicircular leading edge portion having a tip, a mid body portion continuative with the leading edge portion, said mid body portion increasing in width up to a maximum width portion in streamline shape, and then gradually decreasing in width toward the minimum width portion, and a fish tail trailing edge portion continuative with the mid body portion, said fish tail trailing edge portion gradually increasing in width laterally toward both boards or an outboard and terminating in a rear end face having a fixed width;

a reaction fin protruding from an inboard face of said rudder blade on generally the same level with the propeller axis, said reaction fin originating from about the leading edge portion of the rudder blade and extending toward the fish tail trailing edge portion, said reaction fin having a blade section having a fixed fin chord length;

wherein said blade chord length of each rudder blade is between 45 and 60% of said propeller diameter, and wherein said rudders have operating steering gears, and said system further comprises an auto-pilot for controlling rudder angles of the respective rudders, said auto-pilot further comprises a functional circuit for crash stopping maneuver, said auto-pilot controls the respective rudders at crash stopping, and a crash stopping push button to start the functional circuit for crash stopping maneuver, the functional circuit for crash stopping maneuver having control function to make the respective rudders turn to the maximum outboard operable angle, respectively.

4. A twin-rudder system for very large vessels in a high lift twin-rudder system, said system comprising:

a single propeller having a propeller axis and a diameter;

a pair of high lift rudders arranged behind said single propeller nearly parallel in a symmetrical position against the propeller axis;

each high-lift rudder having a rudder blade having:

a blade chord length;

a top end plate and a bottom end plate;

a horizontal sectional profile having a forward protruding semicircular leading edge portion having a tip, a mid body portion continuative with the leading edge portion, said mid body portion increasing in width up to a maximum width portion in streamline shape, and then gradually decreasing in width toward the minimum width portion, and a fish tail trailing edge portion continuative with the mid body portion, said fish tail trailing edge portion gradually increasing in width laterally toward both boards or an outboard and terminating in a rear end face having a fixed width;

a reaction fin protruding from an inboard face of said rudder blade on generally the same level with the propeller axis, said reaction fin originating from about the leading edge portion of the rudder blade and extending toward the fish tail trailing edge portion, said reaction fin having a blade section having a fixed fin chord length;

wherein said blade chord length of each rudder blade is between 45 and 60% of said propeller diameter, and wherein said rudders have operating steering gears, and said system further comprises an auto-pilot for controlling rudder angles of the respective rudders, said auto-pilot further comprises a functional circuit for crash stopping maneuver, said functional circuit controls the respective rudders at crash stopping, the functional circuit for crash stopping maneuver control function to make the respective rudders turn to the maximum outboard operable angle, respectively, in response to a fuel shut-off signal issued by a main engine control system at crash astern maneuver.

* * * * *